US005602571A

United States Patent [19]

Suda et al.

[11] Patent Number: 5,602,571

[45] Date of Patent: Feb. 11, 1997

[54] SHEET FEEDING APPARATUS AND RECORDING SYSTEM WITH IT

[75] Inventors: Masashi Suda, Iruma; Akio Takeda; Sohei Tanaka, both of Kawasaki, all of Japan

[73] Assignee: Canon Kabushiki Kaisha, Tokyo, Japan

[21] Appl. No.: 497,910

[22] Filed: Jul. 3, 1995

Related U.S. Application Data

[63] Continuation of Ser. No. 356,796, Dec. 12, 1994, abandoned, which is a continuation of Ser. No. 203,601, Feb. 28, 1994, abandoned, which is a continuation of Ser. No. 669,184, Mar. 13, 1991, abandoned.

[30] Foreign Application Priority Data

Mar. 14, 1990 [JP] Japan ..... 2-64975
Oct. 12, 1990 [JP] Japan ..... 2-272394

[51] Int. Cl.[6] ..... B41J 11/42; B41J 13/00; B65H 5/06

[52] U.S. Cl. ..... 346/134; 271/265; 271/270; 271/265.01; 271/258; 346/136; 347/104; 400/605; 400/618; 400/708

[58] Field of Search ..... 346/134, 136; 347/104; 216/108; 271/202, 258, 265, 270, 272, 274; 400/618, 605, 636, 637, 708

[56] References Cited

U.S. PATENT DOCUMENTS

| | | | |
|---|---|---|---|
| 4,558,333 | 12/1985 | Sugitani et al. | 346/140 |
| 4,723,129 | 2/1988 | Endo et al. | 347/56 |
| 4,727,437 | 2/1988 | Mizoguchi | 358/304 |
| 4,740,796 | 4/1988 | Endo et al. | 346/1.1 |
| 4,834,277 | 5/1989 | Gomoll et al. | 226/101 |
| 4,858,908 | 8/1989 | Yamada | 271/176 |
| 4,913,574 | 4/1990 | Yokoi | 400/605 |
| 4,941,021 | 7/1990 | Uchida et al. | 355/285 |
| 4,968,164 | 11/1990 | Chevrollier et al. | 400/618 |
| 5,000,439 | 3/1991 | Yoshizawa | 271/274 |
| 5,126,764 | 6/1992 | Miyauchi et al. | 346/138 |

FOREIGN PATENT DOCUMENTS 59-123670 7/1984 Japan .

*Primary Examiner*—John E. Barlow, Jr.
*Assistant Examiner*—L. Anderson
*Attorney, Agent, or Firm*—Fitzpatrick, Cella, Harper & Scinto

[57] ABSTRACT

A sheet feeding apparatus with a recording device for recording an image on a sheet; a first feeding roller disposed at an upstream side of the recording device and adapted to pinch the sheet and to feed the sheet at a first feeding speed; a second feeding roller disposed at a downstream side of the recording device and adapted to pinch the sheet and to feed the sheet at a second feeding speed faster than the frist feeding speed; and a controller for controlling the first and second feeding roller and adapted to perform different controls in accordance with the state that the sheet is fed by both of the first and second feeding roller, or the state that the sheet is fed by either one of first and second feeding roller.

65 Claims, 28 Drawing Sheets

SHEET FEEDING APPARATUS AND RECORDING SYSTEM WITH IT

This application is a continuation of application Ser. No. 08/356,796 filed Dec. 12, 1994, abandoned, which is a continuation of Ser. No. 08/203,601 filed Feb. 28, 1994, abandoned, which is a continuation of Ser. No. 07/669,184 filed Mar. 13, 1991, abandoned.

BACKGROUND OF THE INVENTION

1. Field of the Invention

The present invention relates to a sheet feeding apparatus, and more particularly, it relates to a sheet feeding apparatus for feeding a sheet in a printing portion of a printer and the like.

For example, a printer to which the present invention is applied may be a printer of so-called BJ scan type, wherein after the printing of a line having a predetermined width is effected, an auxiliary scanning is performed by a next predetermined width and a next line is printed, thereby forming an image.

2. Related Background Art

In the past, various printers having heat-sensitive features heat transfer features or ink jet features have been put to practical use. Among them, in an ink jet printer wherein an image is printed on a sheet by discharging liquid, since the sheet was stretched during the printing operation, a countermeasure to the stretching of the sheet was required for performing the accurate feeding of the sheet. That is to say, in the past, a feeding amount of the sheet was controlled by gripper rollers gripping or pinching a non-stretched portion of the sheet (i.e., a portion of the sheet on which an image has not yet been printed), and contact rollers contacting with a printed portion of the sheet were rotated faster than the gripper rollers (for example, by about 5%), thus ejecting the sheet while slipping the contact rollers on the sheet.

Now, when the image is tried to be printed on the whole surface of the sheet having a regular size by shifting a head in a main scanning direction (perpendicular to a plane of FIG. 1), as shown in FIG. 2, since, while the sheet is being fed by the gripper rollers, an auxiliary scanning feed of the sheet is effected by a distance $L_1$ corresponding to a printing width of one line every printing operation, a printed line is correctly contiguous to the previous printed line, thus obtaining the image having no discontinuity. However, when the sheet leaves the gripper rollers, since the sheet is fed only by the faster contact rollers contacting the printed portion of the sheet, the auxiliary scanning feed of the sheet will be effected by a distance $L_3$ longer than the distance $L_1$. Consequently, the printed lines are not contiguous to each other, thus creating a blank area corresponding to a width $(L_3-L_1)$ in the image.

To avoid this, a sheet having a length sufficiently greater than a printing area was used conventionally.

SUMMARY OF THE INVENTION

An object of the present invention is to provide a sheet feeding apparatus which ensures the feeding of a sheet with high accuracy and provides a wide printing area even without using a longer sheet, by feeding the sheet by means of gripper rollers pinching a portion of the sheet on which an image has not yet been printed.

Incidentally, a feeding amount $L_2$ is a transient feeding amount created by the fact that the feeding amount is changed in the way of the line printing operation when the sheet leaves the gripper rollers during the auxiliary scanning feed of the sheet, and has a feed value between $L_1$ and $L_3$.

DETAILED DESCRIPTION OF THE PREFERRED EMBODIMENTS

Now, a first embodiment of the present invention will be explained.

Figure 1:
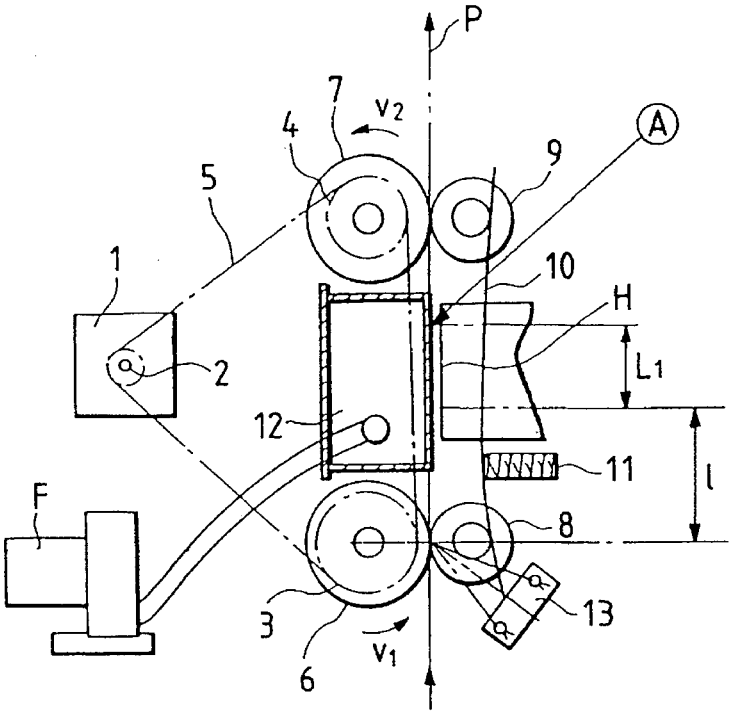
FIG. 1 is a schematic view showing a preferred embodiment of the present invention.
Figure 2:
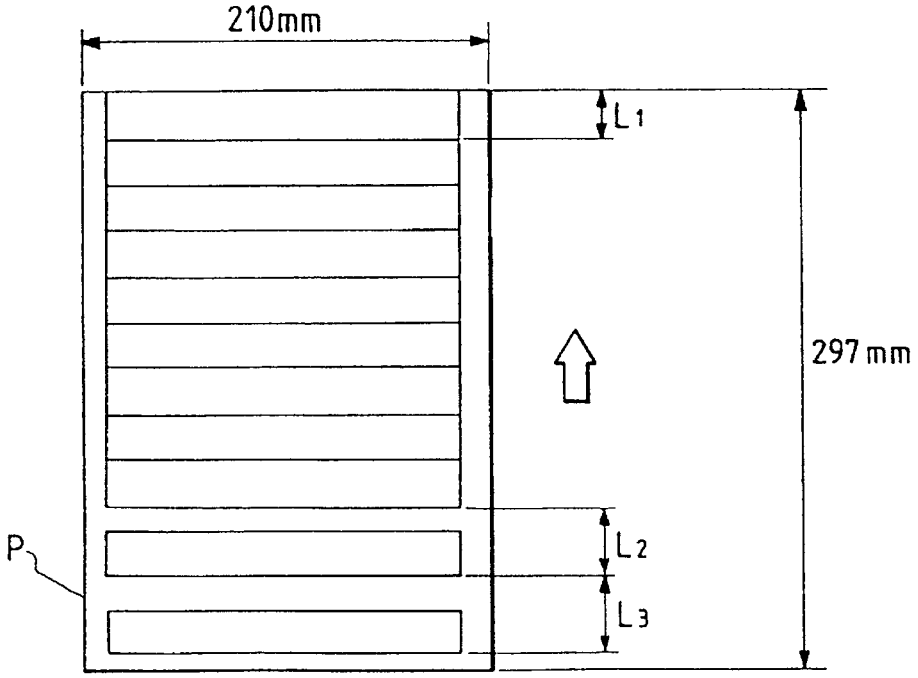
FIG. 2 PRIOR ART
FIG. 2 is a plan view of a sheet showing an example of an image printing by means of a conventional technique.

In FIG. 1, a timing belt 5 wound around a timing pulley 2 fixedly mounted on a motor shaft of a pulse motor 1 transmits a driving force to a timing pulley 3 fixed to a pre-print roller 6 and to a timing pulley 4 fixed to a post-print roller 7. It is preferable that the number of teeth formed on the timing pulleys 3, 4 is integer times more than that of the timing pulley 2 since the influence of eccentricity of the timing pulley 2 can be avoided. More particularly, when the number of teeth of the timing pulley 2 is twelve, it is preferable that the number of teeth of the timing pulley 3 is sixty and the number of teeth of the timing pulley 4 is also sixty. Further, in order that a feeding speed $\upsilon_2$ of the post-print roller 7 becomes faster than a feeding speed $\upsilon_1$ of the pre-print roller 6 by about 5%, a diameter of the post-print roller 7 is selected to have a value greater than a diameter of the pre-print roller 6 by about 5%.

However, it is possible to obtain speed difference of about 5%, by selecting the diameter of the pre-print roller 6 to be same as that of the post-print roller 7 and at the same time by selecting the number of teeth of the timing pulley 4 to be fifty-seven. In this case, substantially the same technical effect can be obtained except that the feeding accuracy of a last few lines is slightly reduced.

A front back-up roller 8 and a rear back-up roller 9 urged against the rollers 6 and 7, respectively, to feed a sheet P are pressed against the rollers 6 and 7, respectively, by means of a leaf spring 10 and a bias spring 11. The pressing force generated by the springs 10, 11 is so selected that a pressure acting on the front back-up roller 8 is sufficiently greater than a pressure acting on the rear back-up roller 9. A platen 12 holds the sheet P thereon in a flat condition by applying the negative pressure to the interior of the platen, and a printing or recording head H is reciprocally shifted in a direction (a main scanning direction) perpendicular to the plane of FIG. 1 while confronting to the sheet P, thus performing the printing of a printing width $L_1$.

Thereafter, the pulse motor is rotated by one revolution to rotate the pre-print roller 6 by ⅕ revolution, thus performing auxiliary scanning of the sheet by a distance $L_1$. In this case, the post-print roller 7 is rotated by an amount corresponding to a sheet feeding amount of ($L_1 \times 1.05$). However, since a sheet pinching force of the post-print roller 7 is weaker than that of the pre-print roller 7, the slip is generated between the sheet and the roller 7, with the result that the sheet is fed by an amount adjusted by the pre-print roller, i.e., by a feed amount of $L_1$; meanwhile, a tension is maintained in the sheet.

A sensor 13 of reflection type faces a nip between the pre-print roller 6 and the front back-up roller 8, thereby detecting a moment when the sheet P has just passed through the nip. In this moment, in order to change the speed of the pre-print roller into a speed previously calculated as will be described later, the number of pulses to be inputted to the pulse motor is varied. The pulse motor 1 used in this embodiment is of a type that one revolution thereof is attained by 1000 pulses, and a concrete explanation will be done using this value.

The sheet P is fed so that a leading end thereof is registered with an upper end (shown by a circled A) of the printing width $L_1$ of the recording head H, and it is assumed that the sheet of A4 size is used. For example, when a head having 400 dpi and 256 nozzles is used, the printing width, i.e., the auxiliary scanning feed amount $L_1$ will be 16.256 mm. Further, if a distance l between a lower end of the printing width $L_1$ and the pre-print roller 6 is 20 mm, during the 17th auxiliary scanning feed of the sheet, the sheet leaves the pre-print roller 6. As soon as the sheet leaves the pre-print roller 6, that is to say, as soon as the sheet has just passed through the nip, the sheet is fed at the feeding speed of the post-print roller 7.

Accordingly, when the number of pulses which was applied to the pulse motor during this auxiliary scanning is N, in order to feed the sheet by 16.256 mm, M (number of pulses) is sought from the following formula, and, by applying the obtained number of pulses to the pulse motor, the sheet can be fed by 16.256 mm:

$$16.256\times(N/1000)+16.256\times(M/1000)\times1.05=16.256.$$

In general expression, when the printing width for one line is W, feed amount for auxiliary scanning is $L_1$, feeding speed of post-print roller is $\upsilon_2$, feeding speed of pre-print roller is $\upsilon_1$, length fed by pre-print roller for one pulse is $L_0$, distance between the lower end of the printing line and pre-print roller is l, and $\upsilon_2/\upsilon_1$ is R, all of these values can be determined unconditionally on the basis of the mechanical design and the like.

When the number of pulses applied to the pulse motor until the trailing end of the sheet detected by the sensor 13 leaves the pre-print roller is N, the number of pulses corresponding to M which meets the following formula may be applied to the pulse motor;

$$L_0 \times N + R \cdot L_0 \cdot M = W \quad (A).$$

In the next auxiliary scanning, the number of pulses corresponding to $M_1$ which meets the following requirement is applied to the pulse motor:

$$R \cdot L_0 \times M_1 = W.$$

It should of course be noted that the further printing for another one scanning is required if the timing is out of place.

Incidentally, during the auxiliary scanning operation, if the trailing end of the sheet is not detected by the sensor 13, the number of pulses ($M_0$) is determined from the following equation:

$$M_0 = L_1 / L_0.$$

As mentioned above, the pulse numbers which are to be applied to the pulse motor to obtain the pre-calculated feeding speed is previously determined, and first and second pulse generators are set on the basis of such pulse numbers. By switching these pulse generators, either one of the pulse numbers or the other is applied to the pulse motor.

Figure 3:
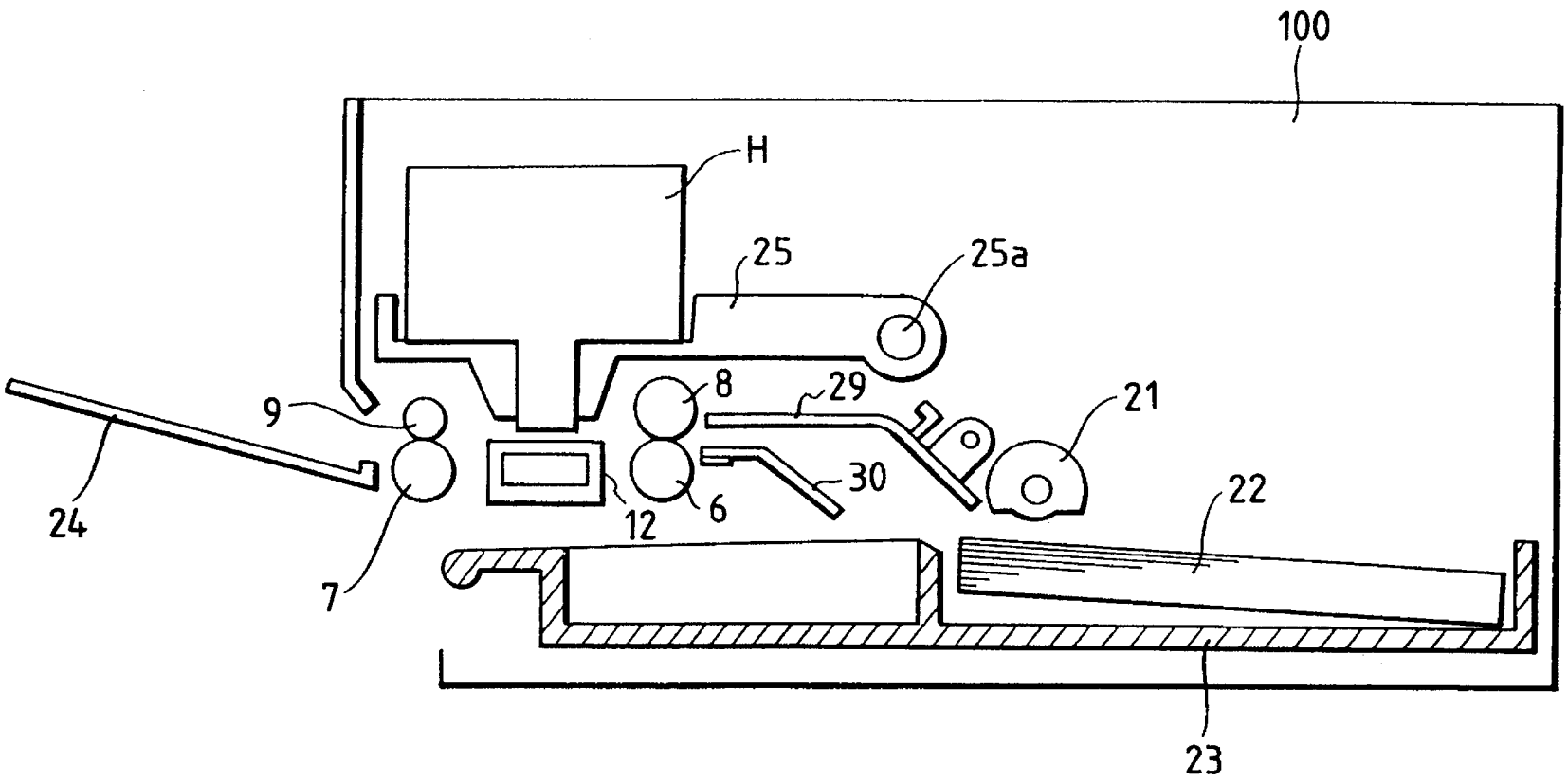
FIG. 3 is an elevational sectional view of an embodiment of an image forming system to which the present invention is applied.

FIG. 3 shows the whole image recording system according to this embodiment.

A cassette 23 within which a plurality of sheets 22 are stacked is arranged on a bottom of a frame 100 of the image recording system. In FIG. 3, a carriage 25 on which the recording head H is mounted is disposed at the left part of the recording system, and a platen 12 is arranged below the recording head H. The recording head H is of ink jet type capable of recording an image on the sheet 22. Further, a carriage drive motor (not shown) is connected to the carriage 25 via a timing belt so that the carriage can be reciprocally shifted along a guide shaft 25*a* by means of the carriage drive motor.

When a sheet supply roller 21 is rotated in response to a sheet supply signal, an uppermost sheet is separated from the stacked sheets 22 (sheet stack) and is fed between sheet supply guides 29 and 30. Then, the sheet 22 is guided by the sheet supply guides 29, 30 and is fed between the pre-print roller 6 rotated by a drive motor (not shown) and the back-up roller 8 driven by the rotation of the pre-print roller 6 to be pinched therebetween. Then, the sheet 22 is passed through the platen 12 by a conveying force generated by the pre-print roller 6 and back-up roller 8 and is directed to the post-print roller 7.

In this condition, the recording head H is shifted from front to back in a direction perpendicular to a plane of FIG. 3 by means of the carriage 25, meanwhile one line having a predetermined width (recording width) is recorded on the sheet 22 by discharging ink in response to the image signal. Whenever the one line recording is finished, the sheet is fed out by an amount corresponding to the recording width by means of the post-print roller 7 and back-up roller 9, thus preparing for the next one line recording operation.

By repeating the above-mentioned operations, the image is recorded on the sheet 22, and, when the one page recording on the sheet is finished, the sheet 22 is ejected from the post-print roller 7 onto an ejector tray 24.

Figure 4:
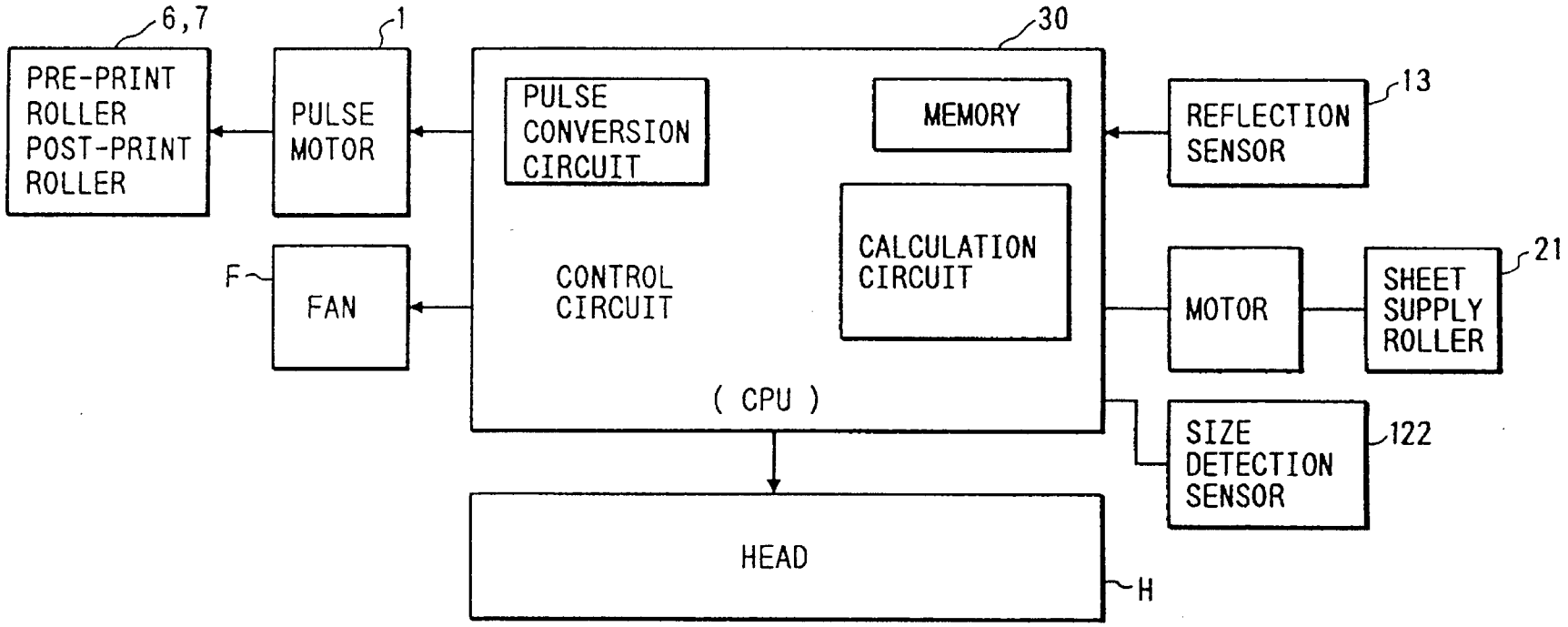
FIG. 4 is a control block diagram for the embodiment of FIG. 3.

FIG. 4 shows a control circuit for this embodiment. In FIG. 4, a CPU 30 includes a calculation circuit, a pulse conversion circuit, a memory and the like.

Figure 5:
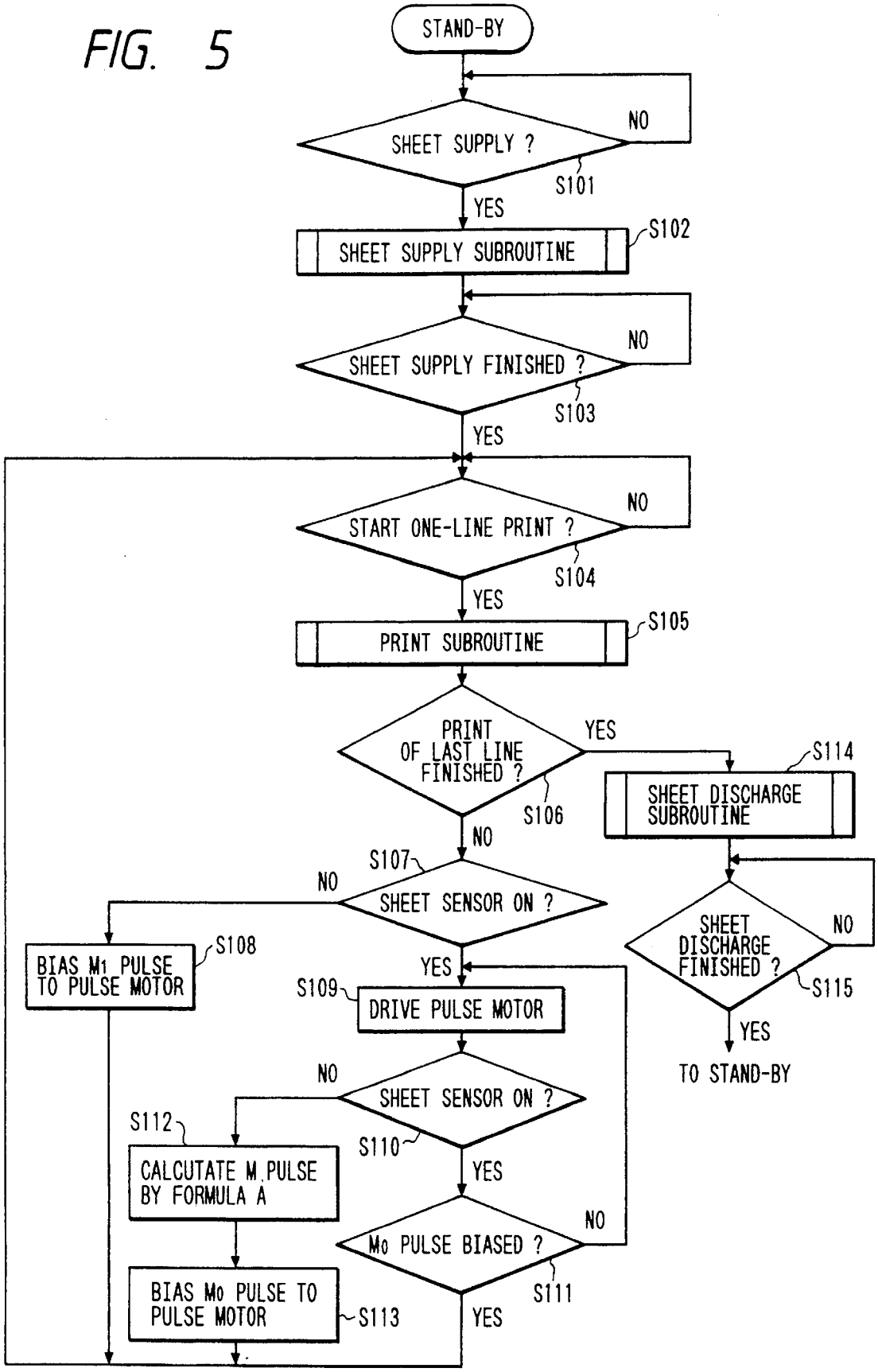
FIG. 5 is a flow chart according to a first embodiment of the present invention.

FIG. 5 shows a control flow chart for this embodiment.

In a step S101, if the sheet supply signal (command) is received, the sheet is fed to the recording head by the supply roller 21 in a step S102, and it is judged whether the sheet supply is finished in a step S103. Thereafter, in a step S104, the sequence waits until a print start command (signal) for one-line is received. If the one-line print start signal is received, in a step S105, a print sub-routine for driving a recording head scanning motor is executed. When the one-line printing is finished in a step S106, it is judged whether the printed line is a last line or not. If negative, the sequence goes to a step S107, where it is judged whether the sheet sensor is turned ON or OFF.

If the sheet sensor is turned OFF, that is, if the sheet is not pinched by the pre-print roller 6 and the back-up roller 8, the pulses $M_1(=W/RL_0)$ are applied to the pulse motor 1 in a step S108, and then, the sequence returns to the step S104, thus waiting for a next one-line print start signal. On the other hand, if the sheet sensor is turned ON, that is, the sheet is pinched by the pre-print roller 6 and the back-up roller 8, the pulse motor is driven in a step S109, and an output signal of the sheet sensor 13 is monitored in a step S110. If the sheet sensor is still turned ON, in a step S111, it is judged whether $M_0$ pulses (i.e., the number of pulses required for shifting the sheet by the distance W in a condition that the sheet is being pinched by the pre-print roller 6 and the back-up roller 8) is applied (biased) to the pulse motor 1. If affirmative, the sequence returns to the step S104; whereas, if negative, the sequence returns to the step S109.

If the sheet sensor 13 is changed to OFF in the step S110, the value M is calculated on the basis of the above-mentioned formula (A), i.e., $$L_0 \times N + R \cdot L_0 \cdot M = W$$

in a step S112, and then, the M pulses are biased to the pulse motor 1 in a step S113. Then, the sequence returns to the step S104.

On the other hand, in the step S106, if the last line has not yet been printed, the sequence goes to a step S114, where a sheet discharge (ejecting) sub-routine is executed. In a step S115, the sequence waits until the sheet discharge is finished. If the sheet discharge is finished, the sequence returns to a stand-by condition for a next sheet supply.

Next, a second embodiment of the present invention will be explained.

It is a length of the sheet is previously known by a sensor 22 for detecting a size of the cassette, it is possible to control the number of pulses for feeding the sheet without detecting the trailing end of the sheet. More particularly, explaining an example that the sheet of A4 size is used, when the printing having the recording width of 16.256 mm is effected, as seventeen auxiliary scanning operations are performed, i.e., as sixteen sheet shifting operations are performed, since the sheet was already fed by 17×16.256 mm, the remaining length of the sheet will be 0.648 mm. Accordingly, during the 17th shifting of sheet, if the sheet is shifted more than 0.648 mm, the sheet leaves the pre-print roller and will be sent by the post-print roller 7. Thus, the feeding pulses during this 17th sheet shifting will be:

$$0.648/0.016256 + (16.256 - 0.648)/0.016256 \times 1.05 \cong 954 \text{ (pulses)}.$$

Since the next auxiliary scanning feed is effected by the post-print roller 7, the number of pulses will be:

$1000/1.05 \approx 952$ (pulses).

In a general expression, when the length of the sheet is $L_p$ and an integral number which meets the following expression (B) is n, the number of pulses $M_2$ to be biased to the pulse motor 1 during n-th sheet shifting becomes the following formula (C):

$$L_1 \times n < L_p - l \leqq L_1 \times (n+1) \quad (B),$$

$$M_2 = \{(L_p - l) - L_1 \times n\}/L_0 + L_{1-\{(L_p - l) - L_1 \times n\}/L_0} \times R \quad (C).$$

In this embodiment, when the information regarding the length of the sheet (generally, the size of the sheet) is inputted, it is necessary to detect the trailing end of the sheet. Incidentally, the number of pulses $M_1$ for the next auxiliary scanning feed is $L_1/L_0 \times R$, as same as the first embodiment.

Figure 6:
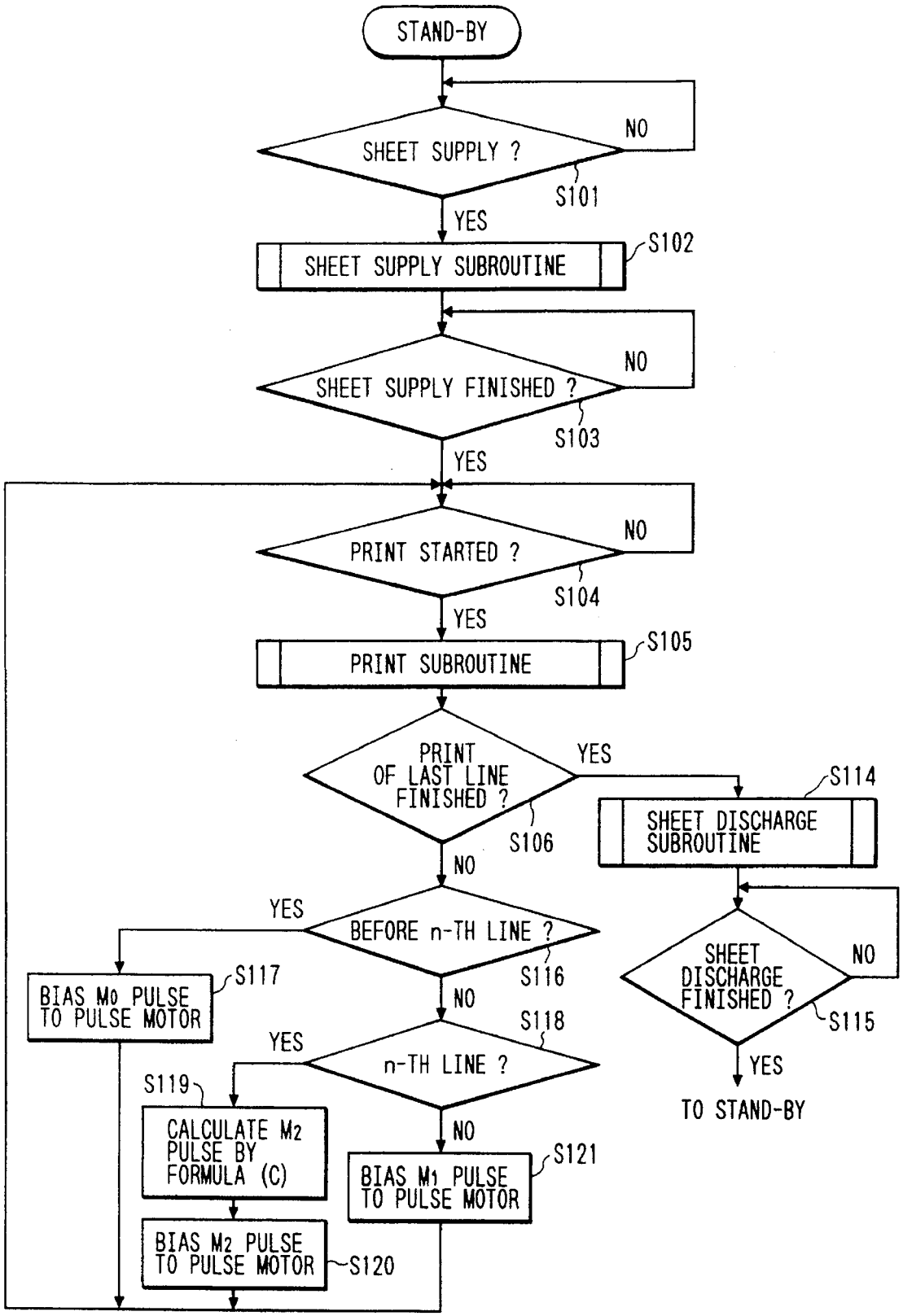
FIG. 6 is a flow chart according to a second embodiment of the present invention.

FIG. 6 shows a control flow chart thereof. Steps S101 to 106, S114 and 115 are the same as those of FIG. 5. In this embodiment, the size of the sheet previously detected by the cassette size detection sensor 122 is stored in the memory of the CPU 30.

In a step S116, it is judged whether the auxiliary scanning to be performed next time is before the n-th line meeting the expression (B) or not. If before the n-th line, in a step S117, the $M_0$ pulses are biased to the pulse motor 1 to feed the sheet. To the contrary, if the n-th line, the sequence goes to steps S118, S119 and S120 successively, so that the $M_2$ pulses calculated on the basis of the formula (C) is biased to the pulse motor. In the step S118, if it is judged that the next auxiliary scanning is after the n-th line, the $M_1$ pulses are biased to the pulse motor. Then, the sequence returns to the step S104.

Figure 7:
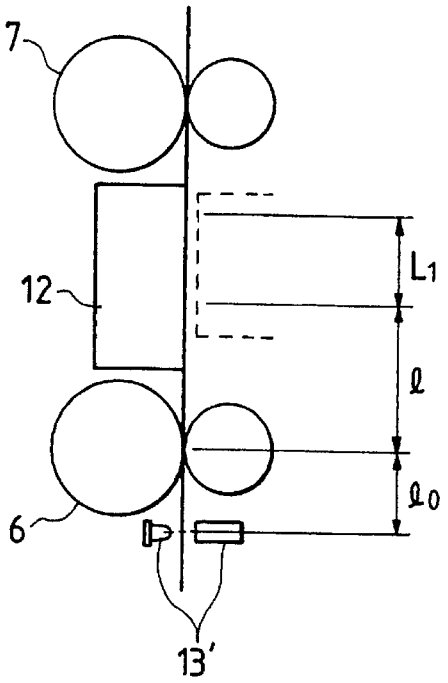
FIG. 7 is a schematic sectional view showing a further embodiment of the invention, wherein a sheet detecting position is varied.

Next, as a further embodiment, an example that the trailing end of the sheet is detected by a sensor 13' at an upstream side of the pre-print roller will be explained with reference to FIG. 7.

In this case, after the trailing end of the sheet is detected, since the sheet is still fed by the pre-print roller by a length $l_0$ corresponding to a distance between the sensor 13' and the pre-print roller 6, if $L_0\ (N+l_0/L_0) \leqq L_1$, when the number of pulses being applied to the pulse motor before a moment when the trailing end of the sheet is detected by the sensor is N, the number of pulses corresponding to M which meets the following requirement may be biased to the pulse motor:

$$L_0(N+l_0/L_0)+M \times L_0 \times R = L_1.$$

If $L_0\ (N+l_0/L_0) > L_1$, since the trailing end of the sheet does not leave the pre-print roller this time, the number of pulses to be biased to the pulse motor this time will be $L_1/L_0$ (pulses). And, if it is assumed that the trailing end of the sheet leaves the pre-print roller during the next auxiliary scanning operation, the number of pulses to be biased to the pulse motor at that time (next time) will be:

$$\{l_0-(L_1/L_0-N)\times L_0\}\div L_0+[L_1-\{l_0-(L_1/L_0-N)\times L_0\}]/(R\times L_0)=\{l_0-(L_1/L_0-N)\times L_0\}/L_0+(-l_0+NL_0)/(R\times L_0)\text{(pulses)}.$$

where, $\{l_0-(L_1/L_0-N)\times L_0\}$ indicates a length of the sheet existing at the upstream side of the pre-print roller. Incidentally, when the trailing end of the sheet leaves the pre-print roller, the sheet tends to restore to its original shape, with the result that the sheet is floated and/or curled to separate from the platen. However, in the illustrated embodiment, since the trailing portion of the sheet is kept in a flat condition by creating the negative pressure within the platen by means of a fan F, the recording head H and/or sheet 2 are prevented from being damaged due to the contact between the recording head and the sheet, thus permitting the recording of the image on the whole surface of the sheet.

Figure 8:
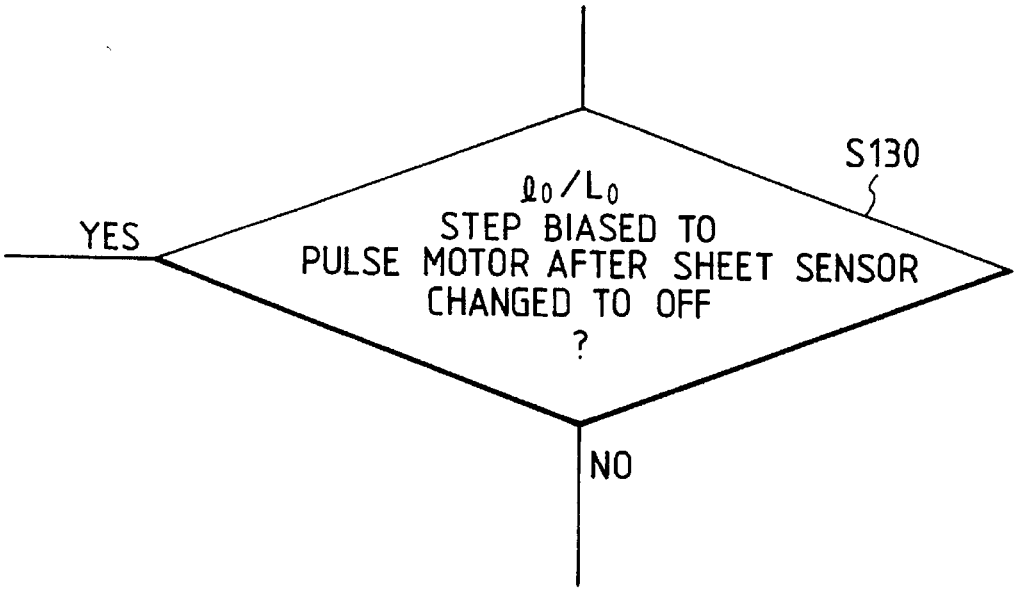
FIG. 8 is a portion of a flow chart for the embodiment of FIG. 7.

Such control can be performed by substituting a step S130 shown in FIG. 8 for the steps S107 and S110 in the flow chart of FIG. 5.

Next, an embodiment of a recording means will be described.

The recording means serves to record an ink image on the sheet fed by a sheet conveying means. In this system, it is preferable to use an ink jet recording means.

The ink jet recording means comprises liquid discharge openings for discharging the recording ink liquid as flying ink droplets, liquid passages communicated with the corresponding discharge openings, and discharge energy generating means disposed associated with the corresponding liquid passages for applying discharge energy to the ink liquid in the respective passages to form the flying droplets. By selectively energizing the discharge energy generating means in response to the image signal, the ink droplets are discharged to form the image on the sheet.

The discharge energy generating means may be, for example, a pressure energy generating means using electrical/mechanical converter elements such as piezo electric elements, an electro-magnetic energy generating means for discharging the ink by applying the electro-magnetic wave such as laser to the ink liquid so as to heat the ink liquid, or a thermal energy generating means for discharging the ink liquid by heating the ink liquid by means of electrical/thermal converter elements. Among them, the thermal energy generating means using electrical/thermal converter elements is most preferable since the discharge openings can be arranged with high density to perform the recording with high resolving power and the recording head can be compacted.

In the illustrated embodiment, a bubble jet recording means of serial-type which is one kind of the ink jet recording means are used as the image recording means.

Figure 9:
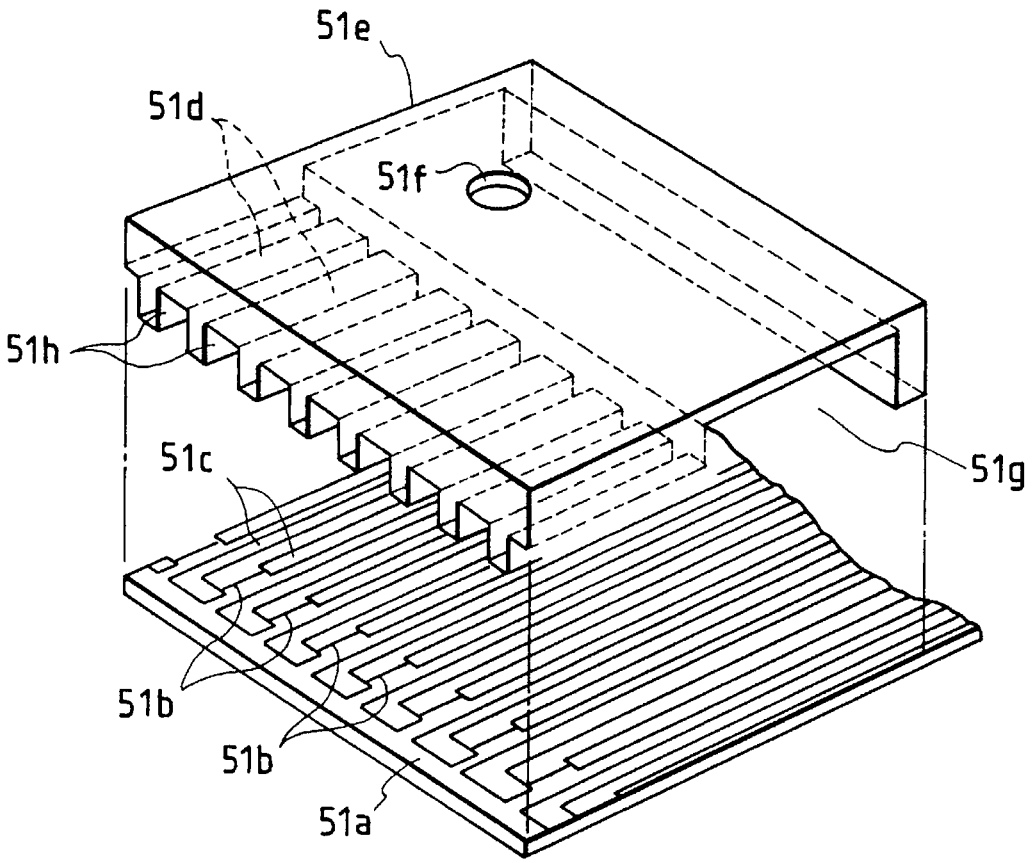
FIG. 9 is an exploded perspective view of a recording head.
Figure 10A:
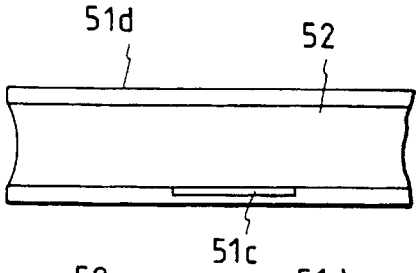
FIGS. 10A to 10G are explanatory views for explaining a bubble jet recording principle.
Figure 10B:
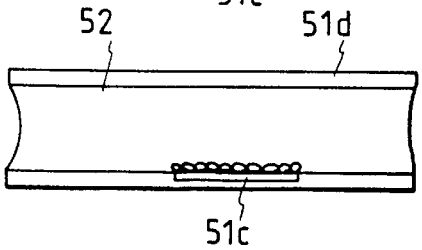
Figure 10C:
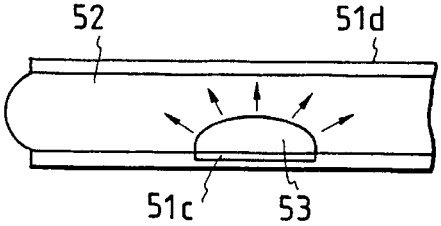
Figure 10D:
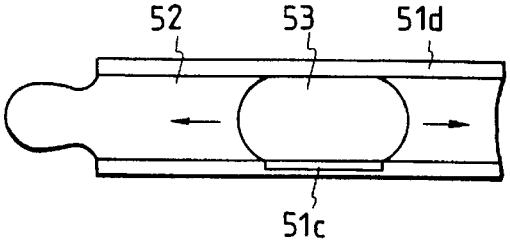
Figure 10E:
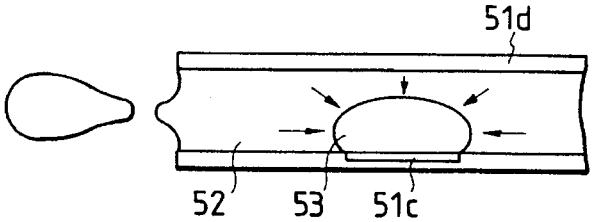
Figure 10F:
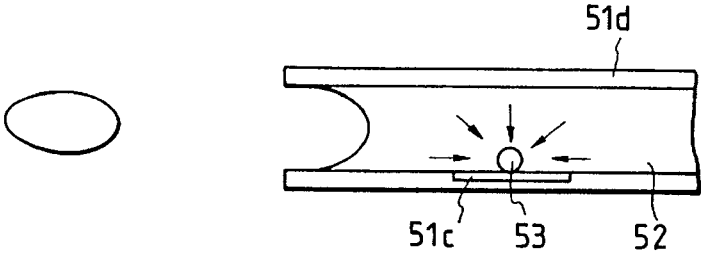
Figure 10G:
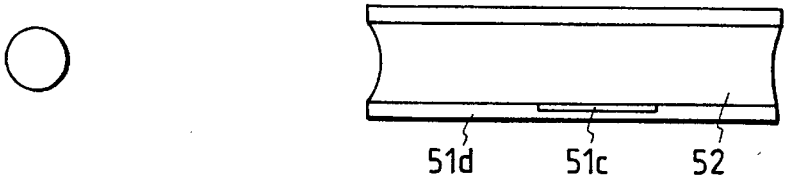

FIG. 9 shows an exploded perspective view of the recording head H constituting the recording means, and FIGS. 10A and 10G show a principle of the bubble jet recording process. Incidentally, the typical construction and principle thereof are disclosed, for example, in U.S. Pat. No. 4,723,129 and U.S. Pat. No. 4,740,796.

In FIG. 9, the reference numeral 51*a* denotes a heater board wherein electrical/thermal converters (discharge heaters) 51*b* and electrodes 51*c* made of aluminium which supply electric powers to the electrical/thermal converters are formed on a silicon substrate by a film forming process. A top plate 51*e* having partition walls for defining recording liquid passage (nozzles) 51*d* is adhered to the heater board 51*a*. Further, an ink cartridge (not shown) for supplying the ink to the recording head 51 is removably mounted on the head in place.

The ink supplied from the ink cartridge to the recording head via a liquid supply tube is directed to a common liquid chamber 51*g* in the head 51 through a supply opening 51*f* formed on the top plate 51*e* and then is sent to the nozzles 51*d* from the common liquid chamber 51*g*. The nozzle 51*d* have ink discharge openigns 51*h*, respectively, which are disposed at a predetermined pitch along a sheet feeding direction in confronting relation to the sheet.

In the illustrated embodiment, the recording head 51 is mounted on a reciprocable carriage and the recording is performed by discharging the ink from the recording head 51 in synchronous with the shifting movement of the carriage.

Now, a principle for forming the flying droplet in the jet recording process will be explained with reference to FIGS. 10A to 10G.

In the steady-state, as shown in FIG. 10A, a tension force of the ink 52 filled in the nozzle 51*d* is equilibrated with the external force at an discharge opening surface. In this condition, when the ink is desired to fly, the electrical/thermal converter 51*d* disposed in the nozzle 51*d* is energized to abruptly increase the temperature of the ink in the nozzle 51*d* exceeding the nucleate boiling. Consequently, as shown in FIG. 10B, the ink portion adjacent to the electrical/thermal converter 51*d* is heated to create a fine bubble, and then the heated ink portion is vaporized to generate the film boiling, thus growing the bubble 53 quickly, as shown in FIG. 10C.

When the bubble 53 is grown at the maximum extent as shown in FIG. 10D, the ink droplet is pushed out of the discharge opening of the nozzle 51*d*. When the electrical/thermal converter 51*d* is disenergized, as shown in FIG. 10E, the grown bubble 53 is cooled by the ink 52 in the nozzle 51*d* to contract. Thus, the growth and contraction of the bubble, the ink droplet is flying from the discharge opening. Further, as shown in FIG. 10F, the ink contacted with the surface of the electrical/thermal converter 51*d* is quickly cooled, thus diminishing the bubble 53 or reduce the volume of the bubble to the negligible extent. When the bubble 53 is diminished, as shown in FIG. 10G, the ink is replenished in the nozzle 51*d* from the common liquid chamber 51*g* by a capillary phenomenon, thus preparing the next formation of the ink droplet.

Accordingly, by reciprocally shifting the carriage and by selectively energizing the electrical/thermal converters 51*b* in response to the image signal, the ink image can be recorded on the sheet. Incidentally, in the ink jet recording system, it is preferable to arrange an ink recovery means at an end of a shifting range of the carriage.

Such ink recovery means serves to prevent the drying of the ink and thus the solidification of the ink around the discharge openings of the recording head 51 by covering or capping the recording head 51 in an inoperative condition. Incidentally, it is preferable to perform the ink recovering treatment, by sucking the ink from the discharge openings by a sucking force created by driving a pump connected to the ink recovery means, in order to prevent the poor discharge of ink or to remove the ink from the discharge openings.

Next, another embodiment of the recording means will be described.

As the recording means, other than the above-mentioned combination of the discharge openings and electrical/thermal converters, a technique that heat acting portions are disposed at curved areas, as disclosed in U.S. Pat. No. 4,558,333 and the Japanese Patent Laid-Open No. 59-12367 can be adopted.

Further, regarding the above-mentioned recording means, while an example that the ink is supplied from the ink cartridge mounted on the recording system to the recording head was explained, a recording head of disposable type wherein an ink containing chamber is formed in the recording head and when the ink in the ink containing chamber is used up the recording head itself is replaced by a new one may be used.

Further, while the bubble jet recording means of serial type was explained in the illustrated embodiment, a recording means of line type may be used.

Now, a bubble jet recording means of line type capable of performing the full-color recording will be briefly described.

Figure 11:
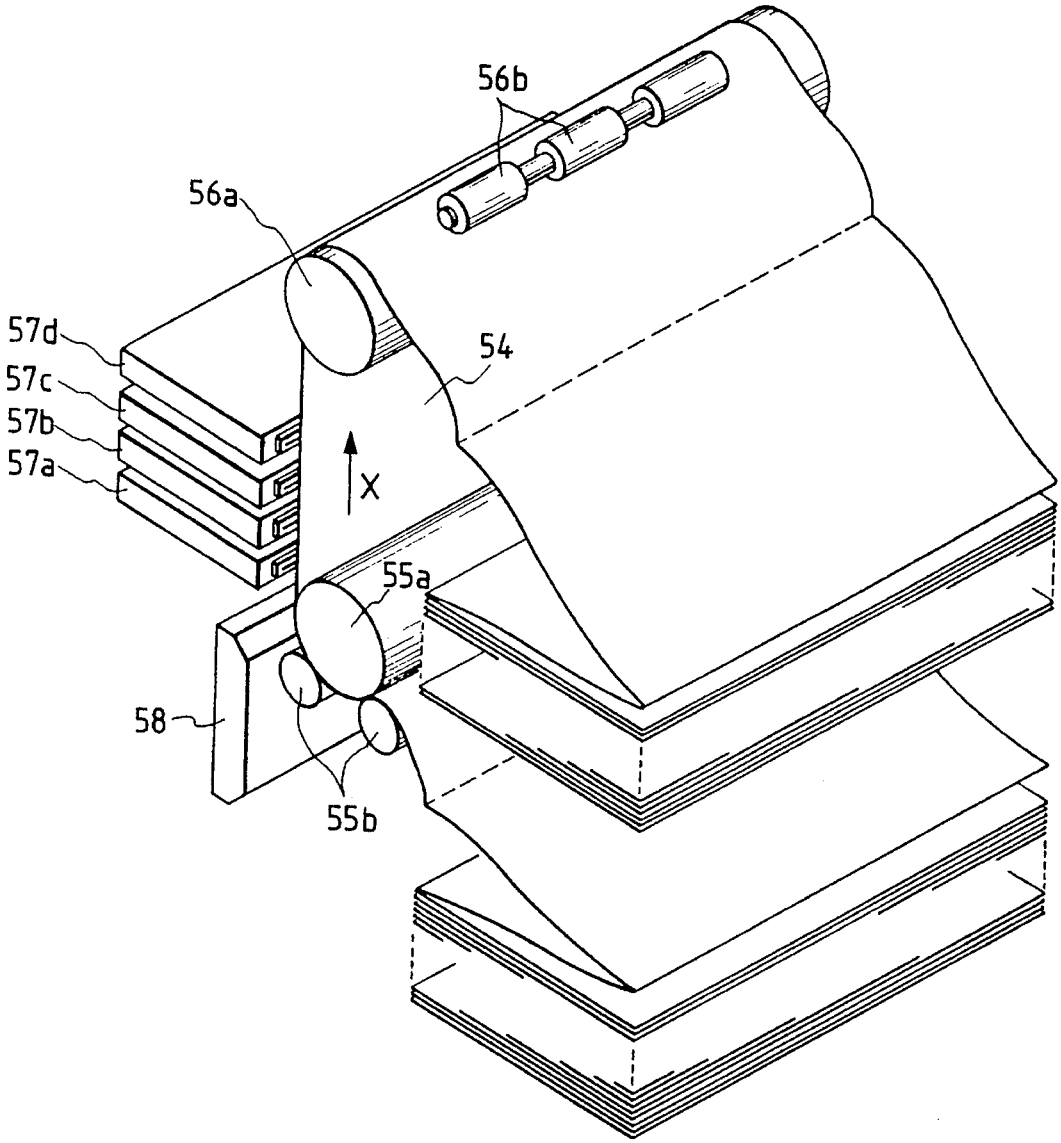
FIG. 11 is a perspective view of a recording means of line type.

In FIG. 11, a recording sheet 54 can be fed in a direction shown by the arrow X by means of an upstream rotating convey roller 55*a* and pinch rollers 55*b*, 55*c* pressed against the convey roller, and a downstream rotating convey roller 56*a* and pinch rollers 56*b* pressed against this convey roller.

Between the convey rollers 55*a* and 56*a*, four recording heads 57*a*–57*d* are arranged in order from an upstream side of a sheet feeding direction to a downstream side thereof, in confronting relation to the recording sheet 54. Each recording head 57*a*–57*d* is a bubble jet recording head of line type capable of recording an image across the whole width of the recording sheet 54. Inks are supplied from ink cartridges (not shown) to the respective recording heads 57*a*–57*d*, so that black color ink is supplied to the recording head 57*a*, yellow color ink is supplied to the head 57*b*, magenta color ink is supplied to the head 57*c* and cyan color ink is supplied to the head 57*d*. The recording heads 57*a*–57*d* are driven in response to color signals corresponding to the respective ink colors to discharge the color ink droplets from their nozzles.

Accordingly, by feeding the recording sheet 54 in the direction X and by driving the recording heads 57*a*–57*d* in synchronous with the feeding movement of the sheet, the full-color image can be recorded on the recording sheet 54.

Incidentally, in FIG. 11, an ink recovery system 58 is arranged below the recording head 57*a*, which recovery system performs the ink discharge recovering treatment when the nozzles are under a non-recording or inoperative condition, to prevent the increase in viscosity of ink and the solidification of ink. When the recovering treatment is effected, the ink recovery system 58 can be faced to the nozzles of the recording heads 57*a*–57*d*, in place of the recording sheet 54. Incidentally, since the recording heads 57*a*–57*d* are pre-heated at a proper timing, the number of the discharge recovering treatments to be performed will be reduced.

Further, in the present invention, the recording means is not limited to the aforementioned ones. For example, a so-called heat transfer recording process wherein an ink sheet coated by heat-soluble ink is heated in response to an image signal and the molten ink is transferred onto a recording sheet, a so-called heat-sensitive recording process wherein a recording sheet capable of producing colors thereon by the heat is heated in response to an image signal, a so-called wire dot recording process wherein an ink ribbon is struck by wires to transfer ink onto a recording sheet in response to an image signal, and other various recording processes can be adopted to the recording means. Accordingly, the recording head is also not limited to the aforementioned bubble jet recording head, but for example, a thermal head, wire dot head, daisy wheel head and the like may be used.

Incidentally, the recording system utilizing the above-mentioned ink jet recording process or bubble jet recording process can be used as a printer which constitutes an image output terminal device of an information treating equipment such as a computer, as a copying machine combined with a reader, or as a facsimile system having bi-communication function.

As mentioned above, for example, since a length of the sheet fed only by the post-print roller can be known by detecting the trailing end of the sheet or by designating the whole length of the sheet, it is possible to record the image on the whole area of the sheet and to prevent the occurrence of the blank portion in the image, which occurred in the conventional techniques. Accordingly, it is possible to record the image substantially on the whole area of the sheet without using the excessively long sheet, since the substantially whole length of the sheet can be shifted by the pre-print roller with high accuracy while performing the auxiliary scanning feed of the sheet, and the feed amount of the sheet shifted by the post-print roller during the last one or two auxiliary scanning operation is corrected.

Next, a third embodiment will be explained.

In this embodiment, the feed amount of the auxiliary scanning is controlled by feeding the sheet at a speed $\upsilon_1$ for a predetermined time period t set by a timer. More particularly, the auxiliary scanning is effected by driving the pulse motor for the predetermined time period t so that the relation $\upsilon_1 t = L_1$ is attained while the sheet is pinched between the pre-print roller 6 and the back-up roller 8.

After the trailing end of the sheet has passed by the pre-print roller 6, a wave length of the pulse to be biased to the pulse motor is lengthened so that a feeding speed of the post-print roller 7 is changed from $\upsilon_2$ to $\upsilon_1$, thus preventing the change in the sheet feeding speed.

Figure 12:
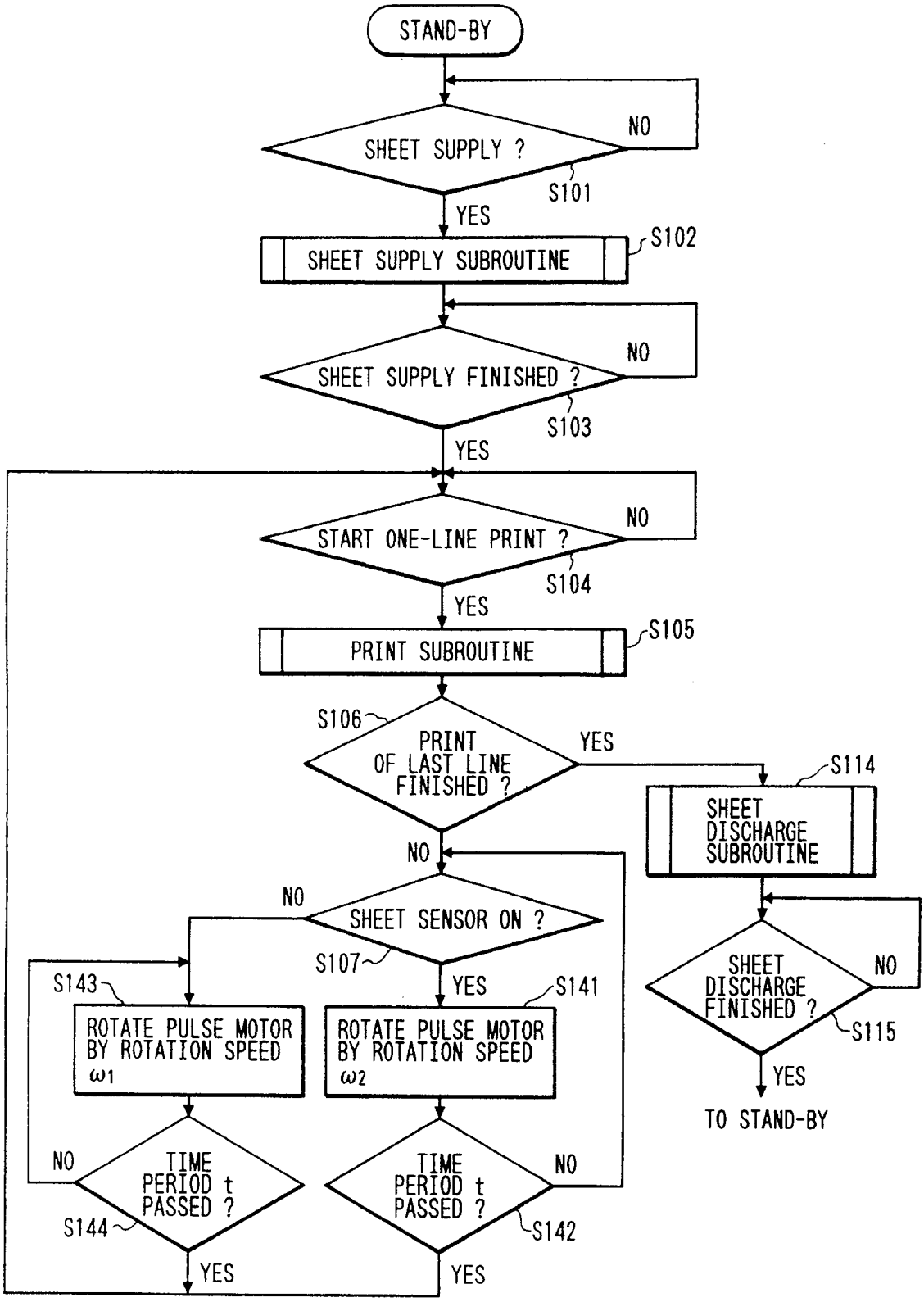
FIG. 12 is a flow chart according to a third embodiment of the present invention.

FIG. 12 shows a control flow chart therefor. In this flow chart, steps S101-S106, S115 and S116 are the same as those of the flow chart shown in FIG. 5. In a step S107, if the sensor 13 is turned ON, i.e., if the sheet is pinched by the pre-print roller 6, the pulse motor is rotated at a speed $\omega_1$ so that the feeding speed of the post-print roller 7 becomes $\upsilon_2$ (step S141). In a step S142, it is judged whether a predetermined time period $t_1$ is elapsed; if not elapsed, the sequence returns to the step S107. In the step S107, if the sheet sensor 13 is turned OFF, i.e., if the sheet has passed by the pre-print roller 6 and is not pinched by this roller, the sequence goes to a step S143, where the pulse motor is rotated at a speed $\omega_2$ so that the sheet is fed by the post-print roller 7 at the speed $\upsilon_1$. In a step S144, if it is judged that a predetermined time period t has been elapsed from the initiation of rotation of the pulse motor, the sequence returns to the step S104; otherwise, the sequence returns to the step S143.

Next, a fourth embodiment of the present invention will be explained with reference to the drawings.

Figure 13:
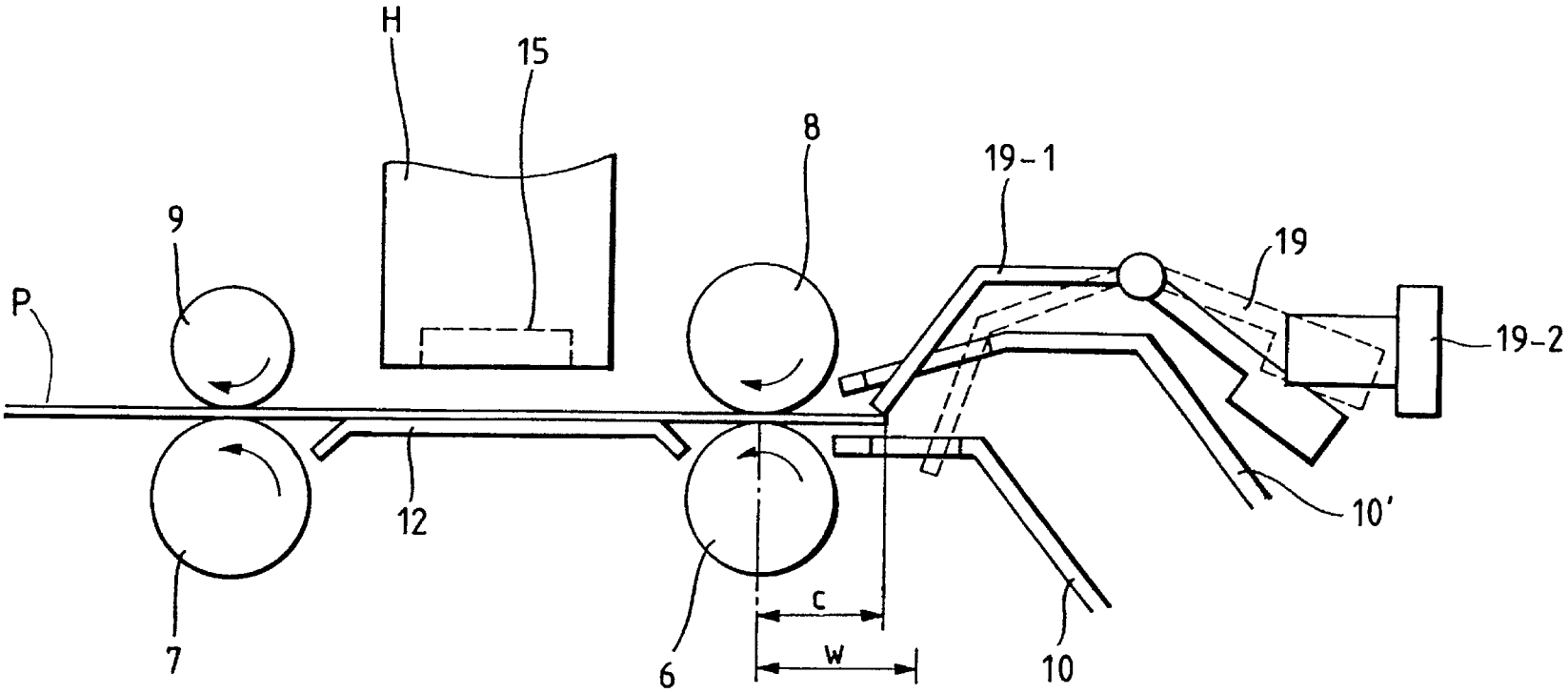
FIG. 13 is a schematic sectional view of an image forming system constituting a fourth embodiment of the present invention.

FIG. 13 shows an image recording system constituting a fourth embodiment of the present invention. In FIG. 13, elements same as those shown in FIG. 3 are designated by the same reference numerals. The reference numeral 19-1 denotes a sensor arm; and 19-2 denotes a sensor of permeable type comprising a light emitting portion and a light receiving portion. These elements 19-1, 19-2 constitute a sheet sensor 20 for detecting the trailing end of the sheet. During the detection of the sheet, the sensor arm 19-1 is positioned in a position shown by the solid line, so that the light from the light emitting portion reaches the light receiving portion. On the other hand, during the non-detection of the sheet, the sensor arm 19-1 is positioned in a position shown by the broken line, so that the light from the light emitting portion is blocked by the sensor arm. The sheet sensor 20 can detect the trailing end of the sheet by utilizing the change in position of the sensor arm as mentioned above.

Figure 14:
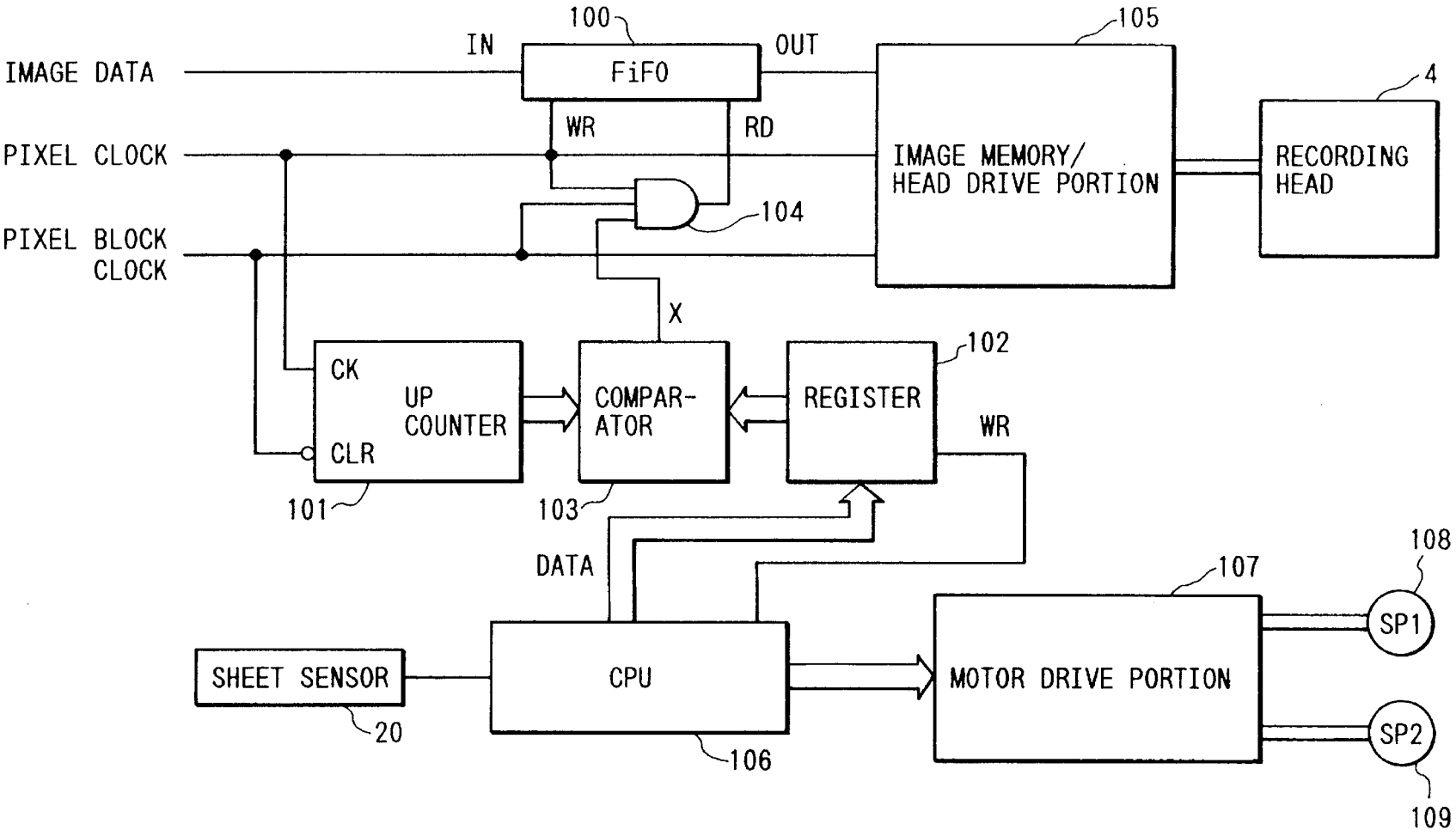
FIG. 14 is a control block diagram of the image forming system of FIG. 13.

FIG. 14 shows a control block diagram regarding the fourth embodiment.

In FIG. 14, an up counter 101 serves to count up pixel clocks and is reset by a pixel block clock. The pixel block clock indicates an effective area of the image data and corresponds to 128 pixel clocks. A print dot position correction value is set in a register 102 by means of a CPU 106. A comparator 103 serves to compare a counted value in the up counter 101 with the print dot position correction value set in the register 102. If the counted value is equal to or greater than the correction value, the comparator emits an output X.

An AND gate 104 serves to AND-calculate the output value of the comparator 103, pixel clocks and pixel clock blocks. A FiFo memory 100 serves to store the image data temporarily. The image data is written in the memory in synchronous with the pixel clock and is read out from the memory in synchronous with an output signal of the AND gate 104.

Figure 15:
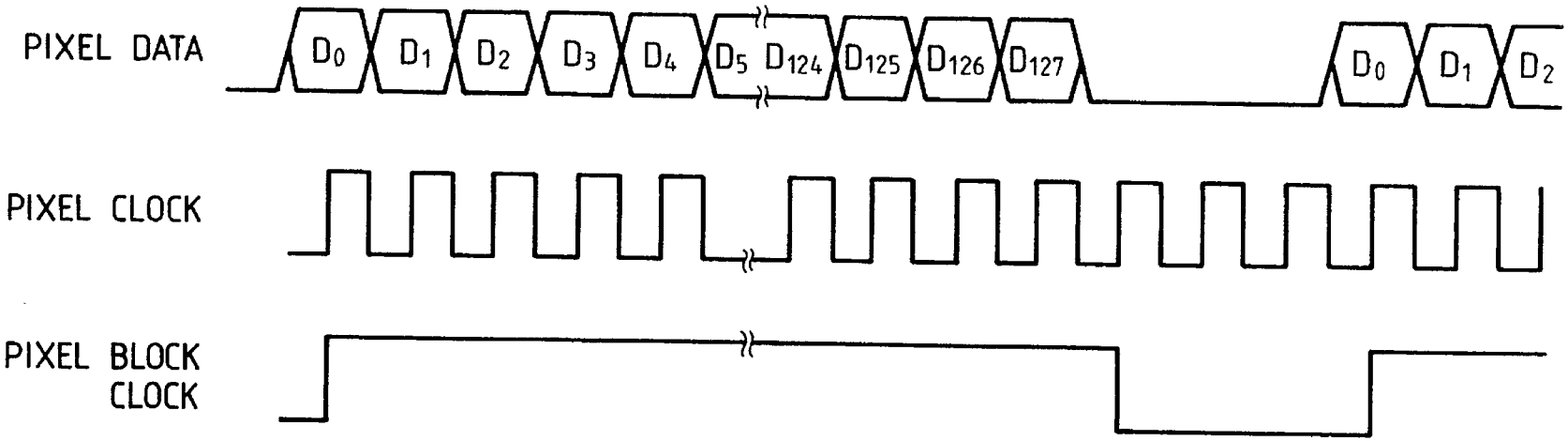
FIG. 15 is a view showing the relation between image data, pixel clocks and pixel block clocks.

FIG. 15 shows the relation between the image data, pixel clocks and pixel clock blocks.

In FIG. 14, an image memory/head drive portion 105 stores the image data from the FiFo memory 100 and serves to drive the recording head on the basis of the stored image data. The reference numeral 108 denotes a pulse motor for scanning the recording head; and 109 denotes a pulse motor for feeding the sheet. The sheet sensor 20 detects the trailing end of the sheet. A motor drive portion 107 serves to drive the pulse motors 108, 109 on the basis of an amount of a trailing end portion obtained by detecting the trailing end of the sheet by means of the sheet sensor.

In the illustrated embodiment, a diameter of a dot is 0.0635 mm, the number of ink discharge openings is 128, recording width W (=m×d) is 8.128 mm, the number of pulses n required for feeding the sheet by the recording width W is 48 pulses, the feed amount t (=W/n) by means of the pre-print roller for 1 pulse is about 0.1693 mm/pulse, and the ratio of the feed amount of the post-print roller to the pre-print roller is 1.01.

Next, a feeding method for the sheet P will be fully explained.

Whenever one-line recording by means of the recording head H is finished, the sheet P is fed by the post-print roller 7 by an amount corresponding to the recording width W. However, in accordance with the remaining amount x of the trailing end of the sheet, the roller associated with the feeding of the sheet differs. That is to say, when a length between the trailing end of the sheet P and a nip of the pre-print roller 6 (a portion which feeds the sheet P) is the remaining amount x of the trailing end of the sheet, (1) in case of $x \geqq W$, the next feeding of the sheet P is also effected by the pre-print roller 6; (2) in case of $0<x<W$, a sheet portion from the trailing end to x is fed by the pre-print roller 6, and thereafter, the sheet is fed by the post-print roller 7; and (3) in case of $x \leqq 0$, the sheet P is fed by the post-print roller.

Further, when the number of pulses required for feeding sheet P by the recording width W by means of the pre-print roller 6 is n and the feed amount attained by the pre-print roller 6 for 1 pulse is t and a feed amount ratio of the post-print roller 7 to the pre-print roller 6 is e, the feed amount l of the sheet P for n pulses will be:

(1) In case of $x \geqq W$ $l = nt$;

(2) In case of $0<x<W$ $l = x + (nt - x)e = -(e-1)x + nte$; and (3) In case of $x \leqq 0$ $l = nte$.

Incidentally, $nt = W = md$.

Figure 17:
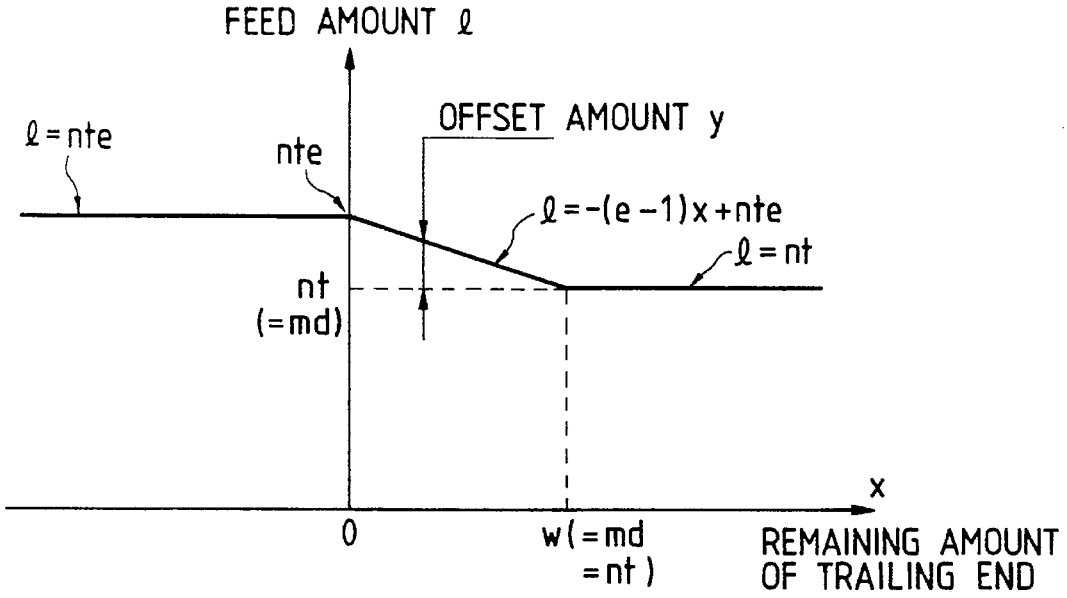
FIG. 17 is a graph showing the relation between a remaining amount (x) of a trailing end of a sheet and a feed amount (l)

Such relation is shown in FIG. 17.

Now, an error y of the feed amount l regarding nte, i.e. , recording width W will be:

(1) In case of $x \geqq W$ $y = 0$;

(2) In case of 0<x<W $$y = -(e-1)x + nte - nt = -(e-1)x + (e-1)nt = (nt-x)(e-1); \text{ and,}$$

(3) In case of x≦0 y=nte−nt=nt (e−1).

Although it is desirable that the error y is zero, such error becomes larger due to the feed amount ratio e and the like, with the result that the feeding accuracy of the sheet P is not satisfied.

Thus, considering the feed amount l of the sheet P in a case where the number of pulses of the pulse motor is reduced by r pulses (i.e., n−r), the feed amount l will be:

(a) In case of x≧W−rt l=(n−r) t;

(b) In case of 0<x<W−rt $$l = x + \{(n-r)t - x\}e = -(e-1)x + (n-r)te = -(e-1)x + nte - rte; \text{ and}$$

(c) In case of x≦0 l=(n−r)te.

Figure 18:
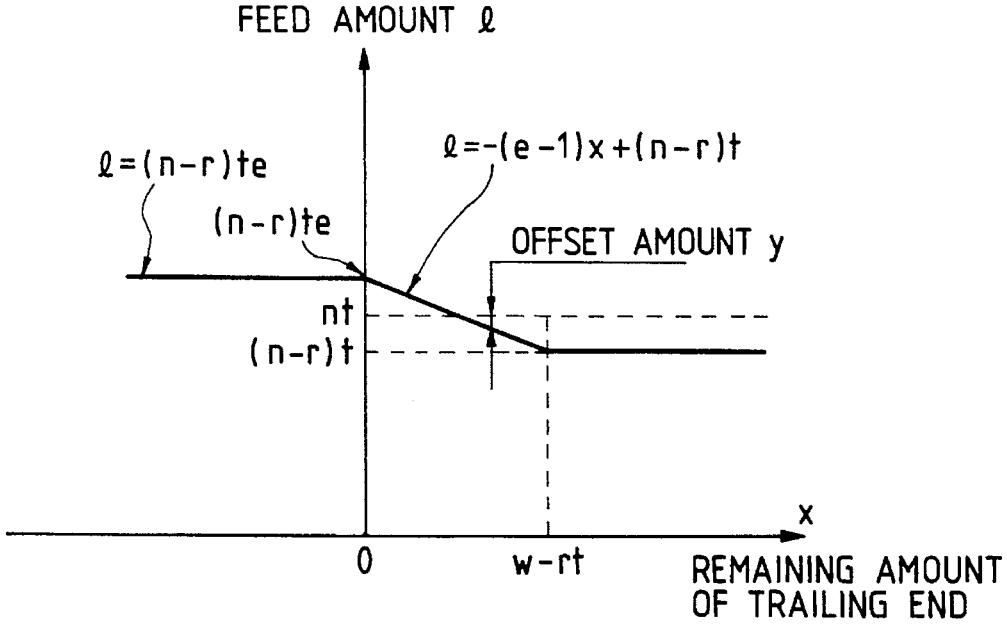
FIG. 18 is a graph showing the relation between a remaining amount (x) of a trailing end of a sheet and a feed amount (l)

Such relation is shown in FIG. 18.

Now, the error y will be:

(a) In case of x≧W−rt y=(n−r)t−nt=−rt;

(b) In case of 0<x<W−rt $$y = -(e-1)x + (n-r)te - nt = -(e-1)x + nt(e-1) - rte; \text{ and,}$$

(c) In case of x≦0 y=(n−r)te−nt=nt(e−1)−rte.

In this case, the feed amount l of the sheet P regarding the recording width sometimes decreases in accordance with the values r and e, with the result that two lines are recorded with overlapping by an amount y.

Now, when the number of dots overlapped is m', if the ink is not discharged regarding the overlapped dots m', the recording width will be W−m'd (=nt−m'd). Thus, the above-mentioned error y will be indicated as y=l−(nt−m'd). So, the error becomes as follows:

(a) In case of x≧W−rt y=(n−r)t−(nt−re'd)=−rt+m'd;

(b) In case of 0<x<W−rt $$y = -(e-1)x + (n-r)te - (nt - m'd) = -(e-1)x + (e-1)nt - rte + m'd; \text{ and,}$$

(c) In case of x≦0 y=(n−r)te−(nt−m'd)=nt(e−1)−rte+m'd.

Therefore, in case of (b), the reduced pulse numbers r and the overlapped dot numbers m' may be so selected that an absolute value of the error y becomes minimum in accordance with the change in x. Similarly, in case of (a) and (c), the reduced pulse numbers r and the overlapped dot numbers m' may be so selected that an absolute value of the error y becomes minimum.

Figure 19:
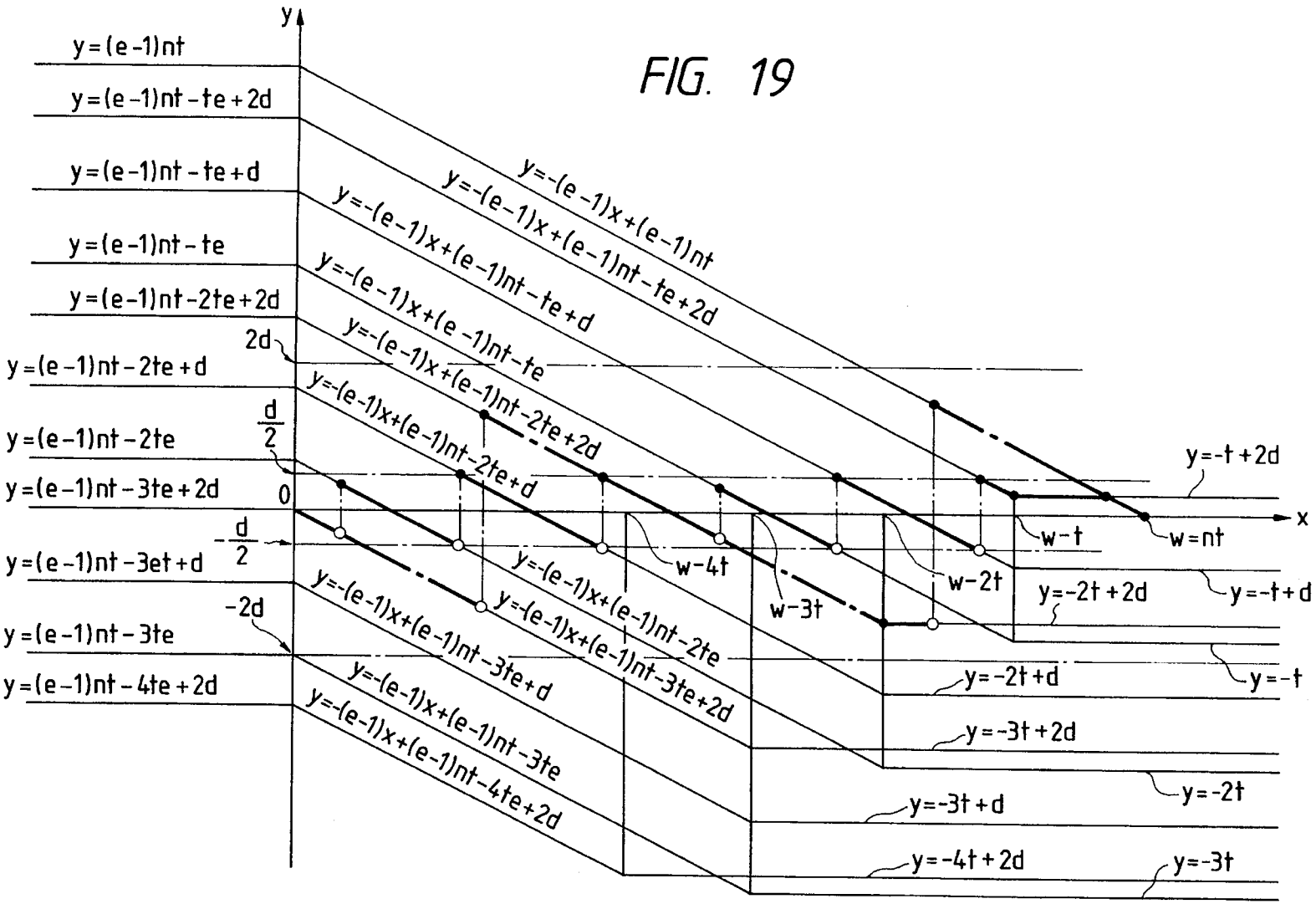
FIG. 19 is an explanatory view for explaining a trailing end treatment.

Such relation is shown in FIG. 19. As seen in FIG. 19, it will be found that the relation shown by thick lines contributes to minimize the absolute value of the error y. Now, the error corresponds to 1 dot (d) (±d/2 dot) at the maximum. Further, if an acceptable value of the error y is ±2d dots, the relation shown by thick dot-and-chain lines will be permitted, thus reducing the number of correction patterns.

In this way, the optimum correction can be effected by the values of the parameters used in the formulae regarding the error y and the acceptable value of the error y. In the illustrated embodiment, while the post-print rollers 7, 9 were rotated in synchronous with the pre-print rollers 6, 8, the post-print rollers may be rotated independently of the pre-print rollers (for example, after the pre-print rollers are stopped, the post-print rollers may be rotated).

Next, a detection method for detecting the trailing end of the sheet will be explained. An example that two correction procedures can be adopted in a range 0~W of the remaining amount x of the trailing end will be described.

Figure 20:
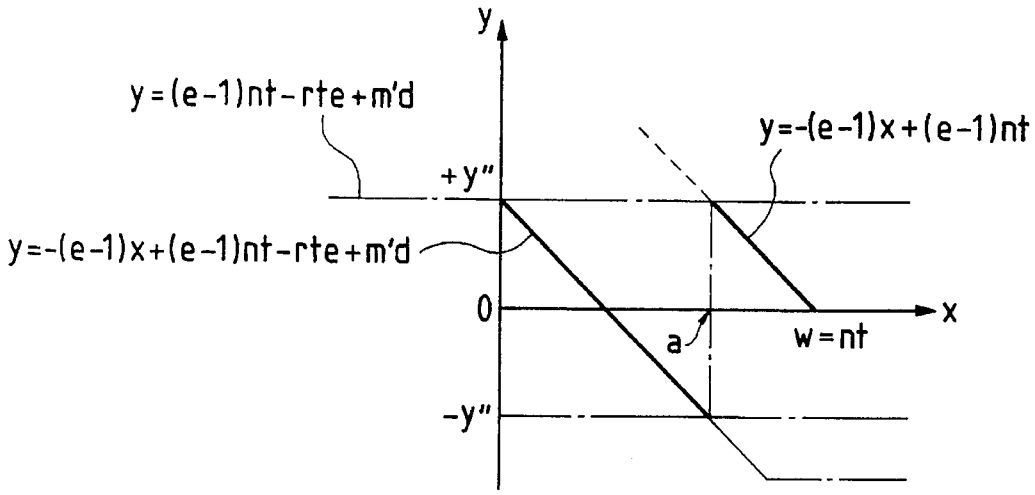
FIG. 20 is a graph showing the relation between a feed amount (x) of the trailing end and a discrepancy amount or error (y)

In this case, in order to limit the error y within ±y", from FIG. 20, when the remaining amount x of the trailing end belongs to the range 0<x≦a, if a formula y=−(e−1)x+(e−1)nt−rte+m'd (r pulses, m' dot correction) is satisfied, the error y becomes minimum; whereas, when the remaining amount x of the trailing end belongs to the range a<x≦nt, if a formula y=−(e−1)x+(e−1)nt (without correction as in the conventional case) is satisfied, the error y becomes minimum.

Figure 21:
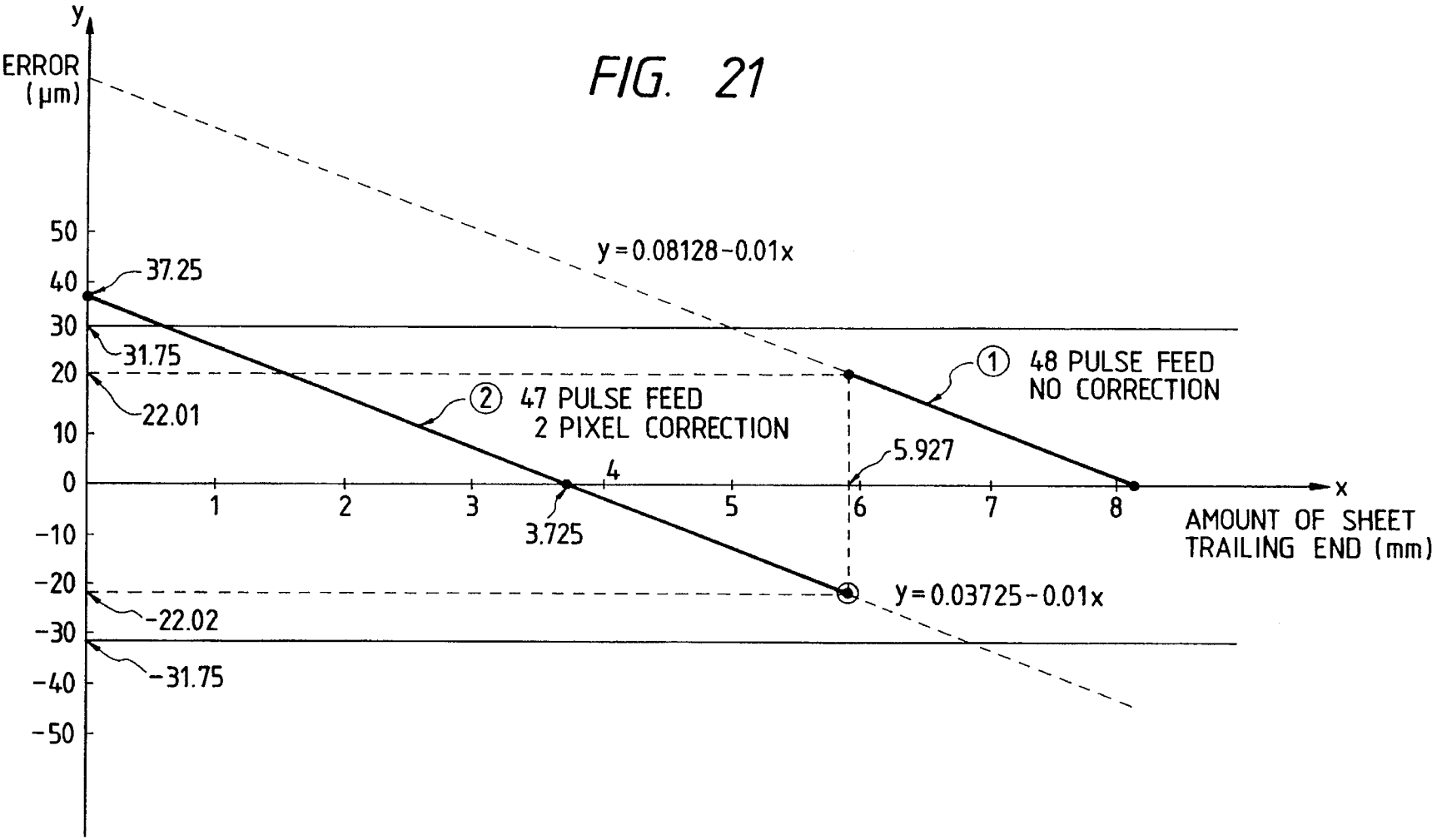
FIG. 21 is a graph for explaining a trailing end treatment performed by means of post-print rollers when the feed amount is increased by 1%.

Accordingly, it is necessary to judge or determine whether the remaining amount x of the trailing end is larger or smaller than the value a. FIG. 21 is an explanatory graph for explaining the trailing end treatment performed by the post-print roller when the feed amount is increased by 1%. By setting a detection position of the sensor arm shown in FIG. 13 to c=a, nt pulses are successively fed, and, if the sensor arm 19-1 is positioned in the solid line position in FIG. 13 in an inoperative condition (condition that the sheet is not being fed), nt pulses are also fed in a next step; whereas, if the sensor arm 19-1 is positioned in the broken line position in FIG. 13, in a next step, (n−r)t pulses are fed and the ink is not discharged by m' dots. In this way, the correction is effected. Consequently, it is possible to limit the error y within the range of ±y". Now, from FIG. 21, it will be found that c=a<W or less is satisfied. However, since the nt pulses are constant, the position of the sensor arm may be set to c'=a+Nnt (N is a positive integral number). That is to say, nt pulses are fed by N times, and the correction may be effected in a next step.

In the illustrated embodiment, the following two control modes can be switched in accordance with the remaining amount x of the trailing end. Thereby, it is possible to limit a print position error to about d/2, i.e., wihtin 0.03175 mm, as shown in FIG. 21.

(1) In case of x≧5.927

Feed amount of pulse motor: 48 pulses;

Print dot position correction: 0 dot (no correction).

(2) In case of x<5.927

Feed amount of pulse motor: 47 pulses;

Print dot position correction: 2 dots.

Figure 16:
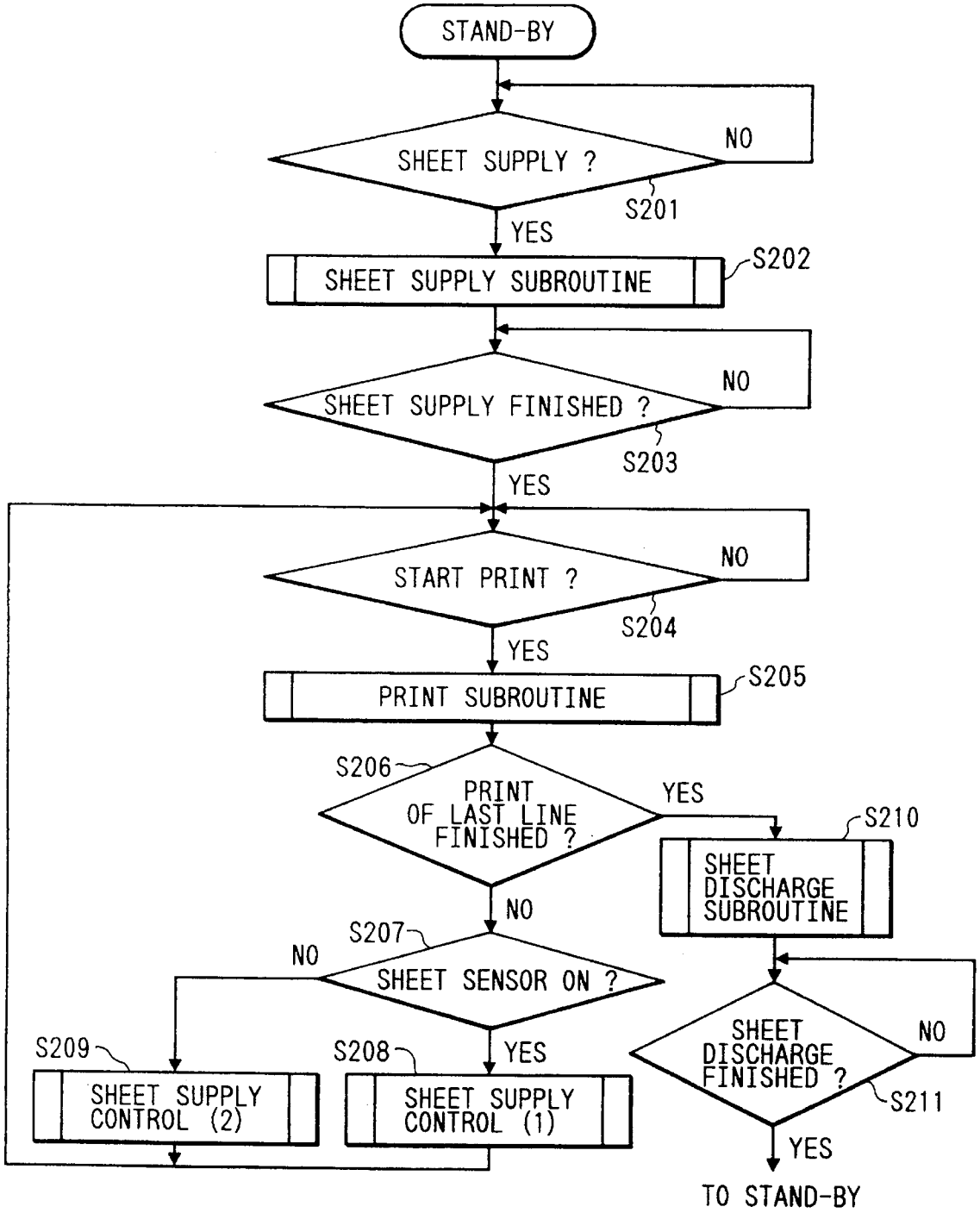
FIG. 16 is a flow chart showing a control sequence executed by a CPU of FIG. 14.

FIG. 16 shows a flow chart indicating a control sequence executed by the CPU 106.

In a step S201, if the sheet supply signal (command) is received, the sheet is fed to the recording head in a step S202, and it is judged whether the sheet supply is finished in a step S203. Thereafter, in a step S204, the sequence waits until a print start command (signal) for one-line is received. If the one-line print start signal is received, in a step S205, a print sub-routine for driving a recording head scanning motor is executed. When the one-line printing is finished, in a step S206, it is judged whether the printed line is a last line or not. If negative, the sequence goes to a step S207, where it is judged whether the sheet sensor is turned ON or OFF.

(a) If the sheet sensor is turned ON, that is, if the trailing end feed amount x≧5.927, the sequence goes to a step S208, where the sheet feeding control routine (1) is executed. That is to say, the feed amount of the pulse motor is selected to 48 pulses and the print dot position correction value is selected to 0 dot (no correction).

In this case, the print error y will be:

$0 \leqq y \leqq 0.02201$.

Thereafter, the sequence returns to a next print start waiting routine. (b) If the sheet sensor is turned to OFF, that is, the trailing end feed amount $x<5.927$, the sequence goes to a step S209, where the sheet feeding control routine (2) is executed. That is to say, the feed amount of the pulse motor is selected to 47 pulses and the print dot position correction value is selected to 2 dots.

In this case, the print error y will be:

$-0.02201<y \leqq 0.03725$.

Thereafter, the sequence returns to a next print start waiting routine.

On the other hand, in the step S206, if it is judged that the last line has been printed, the sequence goes to a step S210, where a sheet ejecting sub-routine is executed. Then, in a step S211, it is judged whether the ejection of the sheet is finished or not; if finished, the sequence returns to a standby condition for a next sheet supply.

By doing so, the relation between the feed amount x of the trailing end and the error y becomes as shown in FIG. 21. As seen in FIG. 21, it will be found that the print position error is limited to about d/2, i.e., within 0.03175 mm.

Figure 25:
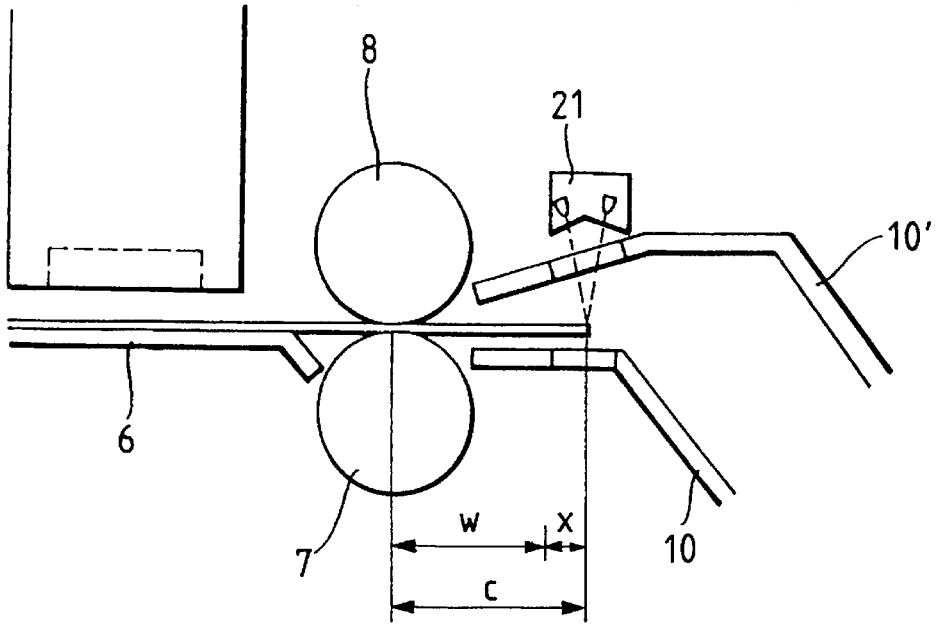
FIG. 25 is an elevational sectional view showing a sensor of reflection type used in the fifth embodiment of the present invention.
Figure 26:
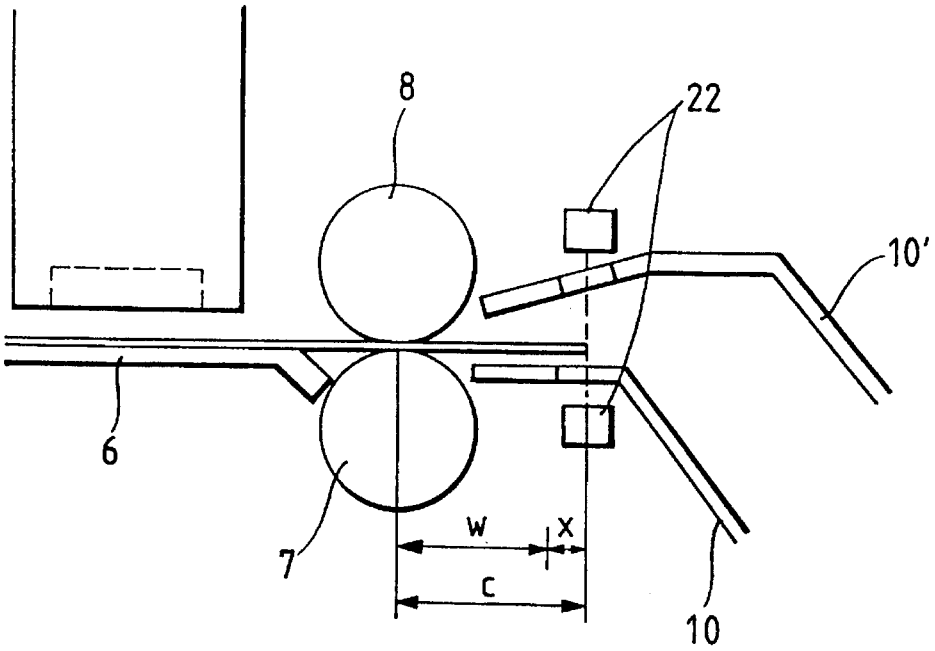
FIG. 26 is an elevational sectional view showing a sensor of permeable type used in the fifth embodiment of the present invention.

Incidentally, a sensor of reflection type as shown in FIG. 25 or a sensor of permeable type as shown in FIG. 26 may be used as the sensor for detecting the trailing end of the sheet.

Next, a fifth embodiment of the present invention will be explained.

In this embodiment, there are three correction procedures in the range 0~W of the remaining amount x of the trailing end.

Figure 22:
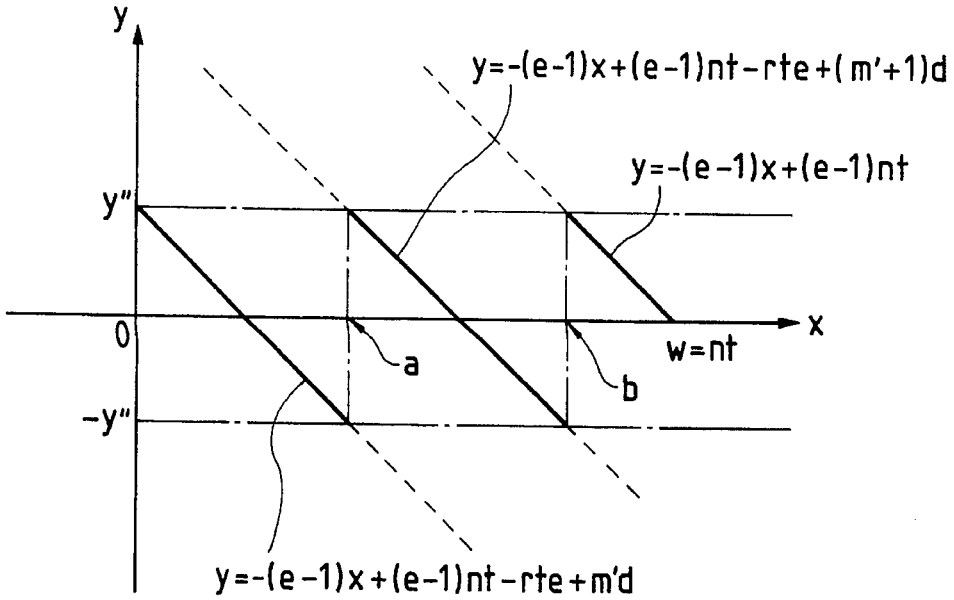
FIG. 22 is a graph showing the relation between a feed amount (x) of the trailing end and an error (y) in a fifth embodiment according to the present invention.

In this case, in order to limit the error y within ±y", from FIG. 22, when the remaining amount x of the trailing end belongs to the range $0 \leqq x \leqq a$, if a formula $y=-(e-1)x+(e-1)nt-rte+m'd$ (r pulses, m' dot correction) is satisfied, the error y becomes minimum; whereas, when the remaining amount x of the trailing end belongs to the range $a \leqq x \leqq b$, if a formula $y=-(e-1)x+(e-1)nt-rte+(m'+1)d$ (r pulses, m'+1 dot correction) is satisfied, the error y becomes minimum, and, when the remaining amount x of the trailing end belongs to the range $b \leqq x \leqq nt$, if a formula $y=-(e-1)x+(e-1)nt$ (no correction as in the conventional case) is satisfied, the error y becomes minimum. Accordingly, it is necessary to judge or determine whether the remaining amount x of the trailing end belongs to $x \leqq a$ or $a \leqq x<b$ or $b \leqq x \leqq nt$, and there are two judging points, i.e., a and b.

Accordingly, since it is impossible to judge the remaining amount of the trailing end of the sheet in the above-mentioned condition that the sheet is stopped, the remaining amount of the trailing end will be detected in a condition that the sheet is being moved.

When the sensor arm 19-1 and the sensor 19-2 of permeable type are used as in the case of FIG. 13, the number n" of pulses biased to the pulse motor during a time period from when the sensor of permeable type emits the signal (after the trailing end of the sheet leaves the sensor arm 19-1 and the latter is positioned in the broken line position in FIG. 13) to when the sheet is stopped is counted. If the position of the sensor arm 19-1 is c, the remaining amount x of the trailing end of the sheet can be indicated as follows:

$x=c-n''t$ ($n'' \leqq n$, $nt<c<2nt$); or $x=c-Nnt-n''t$ ($n'' \leqq n$, $2nt \leqq c$, N is natural number).

Now, it is necessary that the relation $c>W$ is satisfied (since, if $c<W$, the value x may be negative in accordance with the value n").

Figure 23:
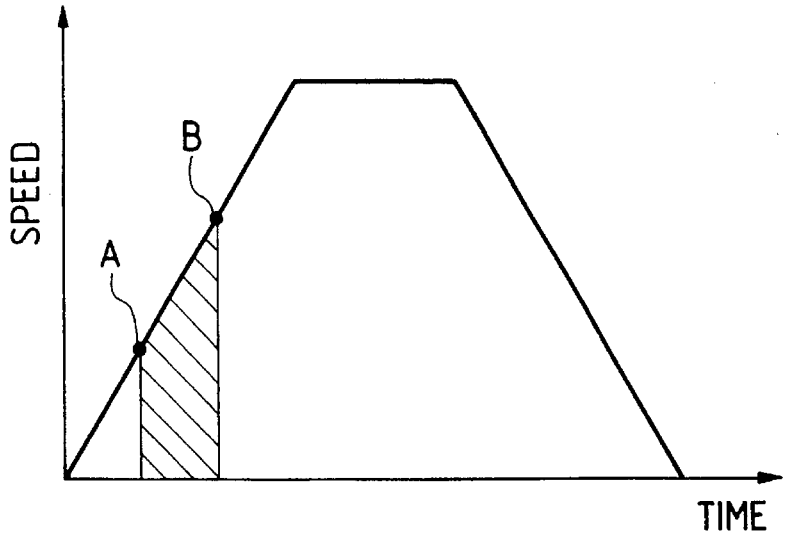
FIG. 23 is a graph for explaining the control of a feed sheet of the sheet.
Figure 24:
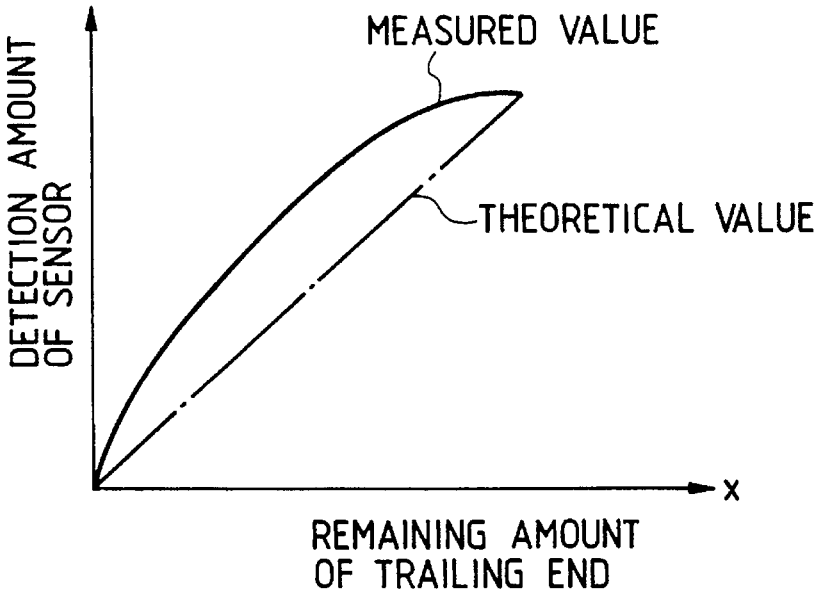
FIG. 24 is a graph showing the relation between the remaining amount of the trailing end and a detected amount detected by a sensor.

However, when the sheet is fed by the recording width, the feeding speed of the sheet has an acceleration/uniform/deceleration speed pattern as shown in FIG. 23, and, it takes a certain given time to bring the sensor arm 19-1 to the broken line position in FIG. 13 (for example, it takes about 10 msec in order that an object falls by 0.5 mm by its own weight). Thus, for example, even if the trailing end of the sheet leaves the sensor arm 19-1 at a point A in FIG. 23, when the sensor arm 19-1 is rotated and reaches the broken line position in FIG. 13, a time period (B-A) has been elapsed, with the result that there arises an error by an amount shown by a hatched area in FIG. 23. Consequently, the remaining amount of the trailing end of the sheet calculated on the basis of the sheet trailing end detection output from the sheet sensor 20 will greatly differ from the actual remaining amount of the trailing end. Such relation is shown in FIG. 24.

Accordingly, in the illustrated embodiment, the error due to the elapsed time period is reduced by using the sensor of reflection type (FIG. 25) or of permeable type (FIG. 26), which sensor has a response time of 1 msec or less. Now, the position c of the sensor should satisfy the relation $W<c$. In the illustrated embodiment, the following values are used:

Dot diameter: 0.0635 [mm];

Number of ink discharge openings: 128;

Recording width W (=m×d): 8.128 [mm];

Number of pulses required for feeding sheet by W: 48 [pulses];

Feed amount t (=W/n) of post-print roller for 1 pulse: about 0.1693 [mm/pulses]; and Feed amount ratio e of pre-print roller to post-print roller: 1.02.

Figure 27:
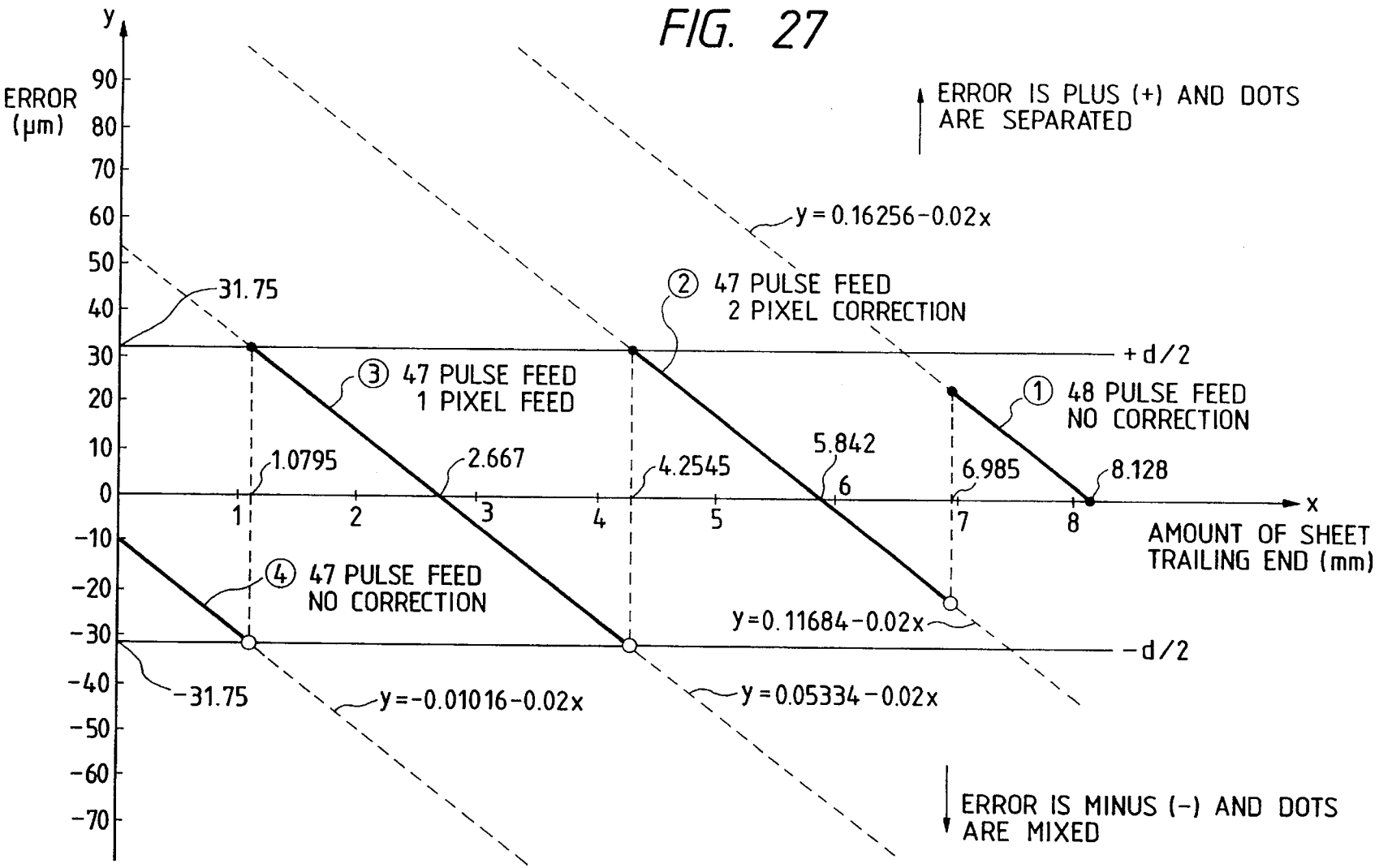
FIG. 27 is a graph for explaining a trailing end treatment by means of the post-print rollers when the feed amount is increased by 2% in the fifth embodiment.

By switching the following controls (1)~(4) on the basis of the remaining amount x of the trailing end, it is possible to limit the print position error within d/2 (=0.03175 mm), as shown in FIG. 27 which shows a graph for explaining the trailing end treatment effected by the pre-print roller when the feed amount is increased by 2%:

(1) In case of $x \geqq W$ (8.128 mm)

Feed amount of pulse motor: 48 pulses; and

Print dot position correction: 0 dot (no correction).

In this case, the print error y is:

$y=0$ mm.

In case of $8.128>x \geqq 6.985$,

Feed amount of pulse motor: 48 pulses; and

Print dot position correction: 0 dot (no correction).

In this case, the print error y is:

$0 \leqq y \leqq 0.02286$ mm.

(2) In case of $6.985>x \geqq 4.2545$

Feed amount of pulse motor: 47 pulses; and

Print dot position correction: 2 dots.

In this case, the print error y is:

$-0.02286<y \leqq 0.03175$ mm.

(3) In case of $4.2545>x \geqq 1.0795$

Feed amount of pulse motor: 47 pulses; and

Print dot position correction: 1 dot.

In this case, the print error y is:

$-0.03175<y \leqq 0.03175$ mm.

(4) In case of $1.0795>x \geqq 0$

Feed amount of pulse motor: 47 pulses; and

Print dot position correction: 0 dot (no correction).

In this case, the print error y is:

$-0.03175<y\leqq-0.01016$ mm.

In case of 0>x,

Feed amount of pulse motor: 47 pulses; and

Print dot position correction: 0 dot (no correction).

In this case, the print error y is:

y=−0.01016 mm.

Figure 28:
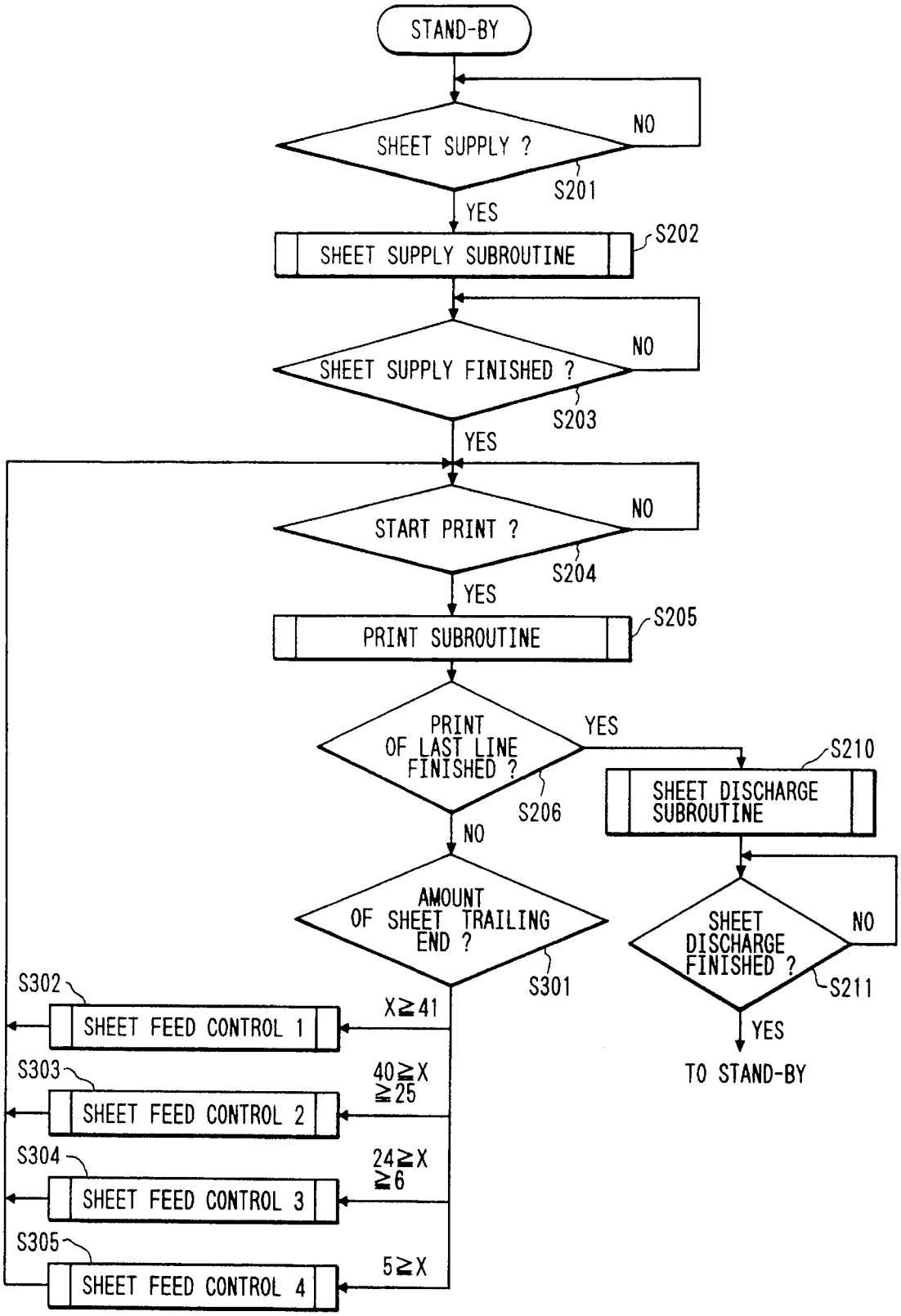
FIG. 28 is a flow chart showing a control sequence executed by a CPU of FIG. 1 in the fifth embodiment.

FIG. 28 is a flow chart showing a control sequence executed by the CPU 106 of FIG. 14.

The control sequence from a step S201 to a step S206 is the same as that of the fourth embodiment. In the step S206, it is judged whether the printing of the last line is finished. If not finished, the sequence goes to a step S301, where it is judged whether the remaining amount x of the trailing end detected during the former sheet feeding after one-line printing belongs to $x\geqq41$, or $40\geqq x\geqq25$, or $24\geqq x\geqq6$, or $5\geqq x$. In accordance with the remaining amount x of the trailing end, a sub-routine for executing one of the above-mentioned controls (1) to (4) is selected in steps S302 to S305.

Figure 29:
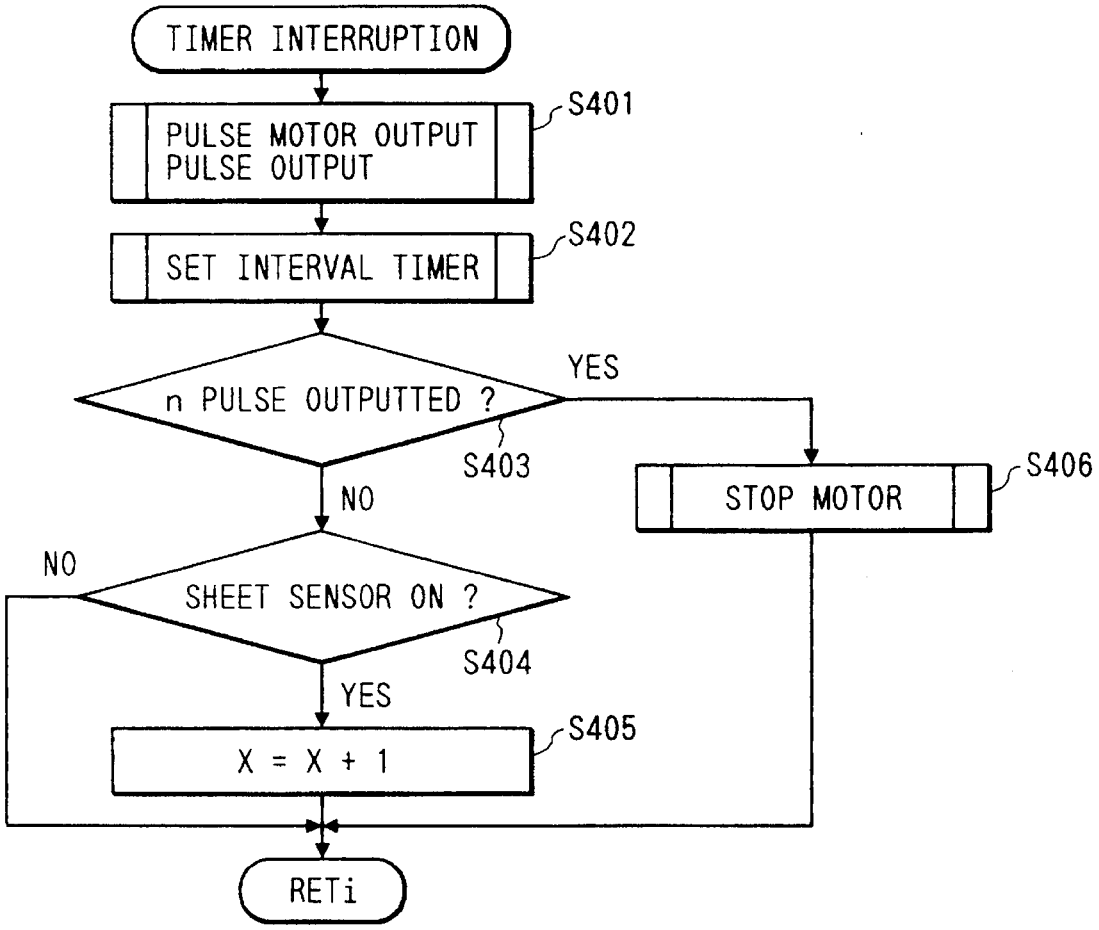
FIG. 29 is a flow chart showing a treatment sequence in a timer interruption routine.

A routine for measuring the amount of sheet trailing end is executed in a timer interruption routine for generating pulses to rotate the pulse motor. The timer interruption routine is shown in FIG. 29.

In a step S401, a pulse for producing an excitation phase following to a previous excitation phase to rotate the pulse motor is outputted. In a step S402, an interval time for a next timer interruption to output a next pulse is set. In a step S403, it is judged whether n pulses are outputted or not; if the n pulses set in the sheet feeding control (in the illustrated embodiment, 48 or 47 pulses) has not yet been outputted, the sequence goes to a step S404, where it is judged whether the sheet exists or not on the basis of the input from the sheet sensor at that time; if affirmative, a sheet trailing end amount counter X is incremented in a step S405, and then the sheet feeding control is finished. On the other hand, if negative in the step S404, the sheet feeding control is finished without incrementing the counter.

Accordingly, since the trailing end of the sheet leaves the sheet sensor during the feeding of the sheet, a value of the sheet trailing end amount counter X will be $0\leqq X\leqq48$. In the illustrated embodiment, since one unit of X corresponds to 0.1693 mm, the following values are obtained:

Sheet length for selecting sheet feeding control (1): 6.985 mm, i.e., $X\cong41$;

Sheet length for selecting sheet feeding control (2): 4.2545 mm, i.e., $X\cong25$;

Sheet length for selecting sheet feeding control (3): 1.0795 mm, i.e., $X\cong5$.

On the other hand, in the step S403, if the n pulses was outputted, the pulse motor is stopped in a step S406, and then the sheet feeding control is finished.

Incidentally, in the illustrated embodiment, while an example that there are three correction procedures was explained, four or more correction procedures can be treated similarly.

Next, a sixth embodiment of the present invention will be explained.

In this embodiment, the sheet to be fed has regular size (A4, B5 and the like), and thus, the size of the sheet is already known, and the detection of the sheet size is performed by the sheet cassette. In this case, although the aforementioned two examples are effective, other method will be described.

Figure 30:
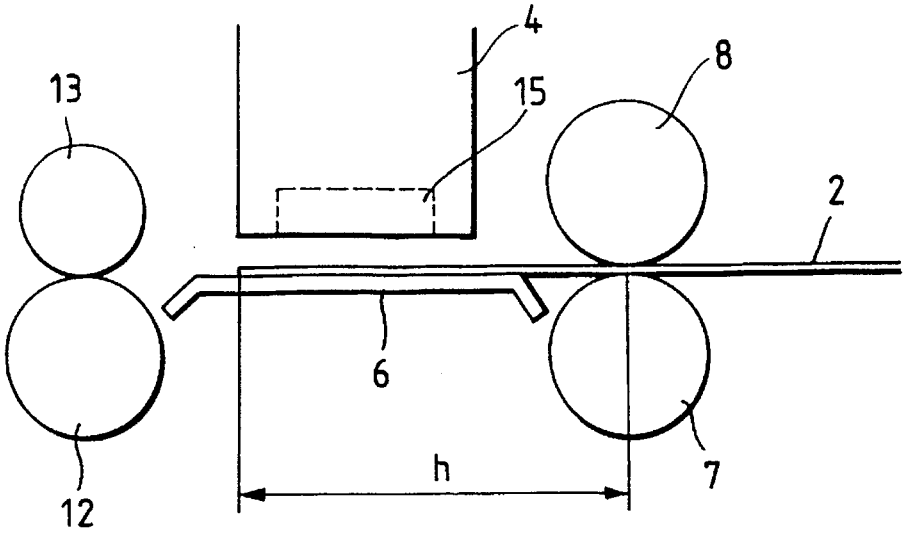
FIG. 30 is an elevational sectional view for explaining the feeding of the sheet.

In an example that after a leading end of the sheet P is slightly protruded from a pre-print roller 6 a post-print roller 7 is once rotated reversely to tame the leading end of the sheet for the nips of the post-print roller 7 and the pre-print roller 6 and hen the sheet is fed, as described in the Japanese Patent Application No. 1-73033, the number of revolutions of a pulse motor for feeding the sheet can be correctly counted. Now, the sheet has a regular size, and thus, the size of the sheet is already known. When a length of the sheet P is l and a sheet amount firstly fed for performing the recording (calculated from the number of revolutions of the pulse motor; refer to FIG. 30) is h, the remaining amount x of the trailing end of the sheet is indicated as follows:

x=l−h−Nnt (N is a positive integral number satisfying the relation $0<x<nt$). Thus, since the size of the sheet is already known, the remaining amount x of the trailing end can be easily calculated on the basis of the length l of the sheet 2, and the correction procedure can be determined on the basis of the calculated sheet trailing end feed amount.

Figure 31:
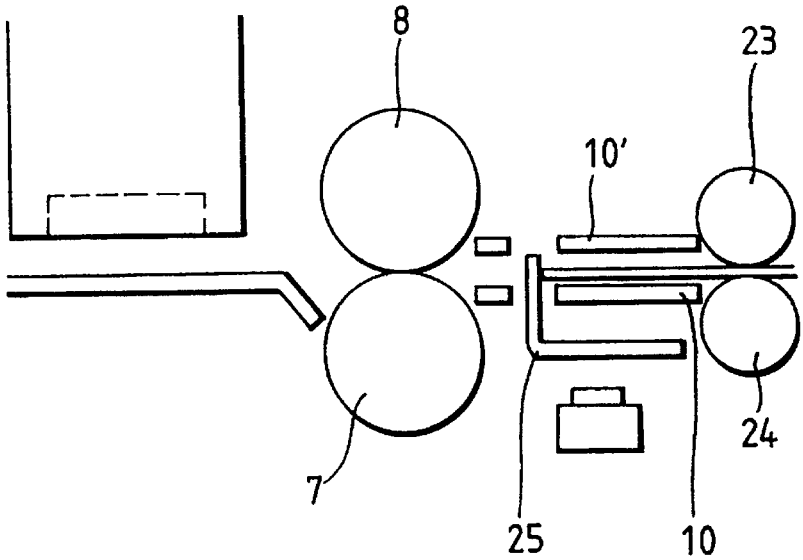
FIG. 31 is an elevational sectional view showing an arrangement a pair of upper and lower slip rollers and a regist shutter.

Further, by using the combination of upper and lower slip rollers 23, 24 and a register shutter 25 as shown in FIG. 31, a sheet feeding timing can be constant. And, when the sheet amount h firstly fed is constant, the correction can be effected similarly on the basis of the size of the sheet 2.

Next, a seventh embodiment of the present invention will be explained.

Figure 36:
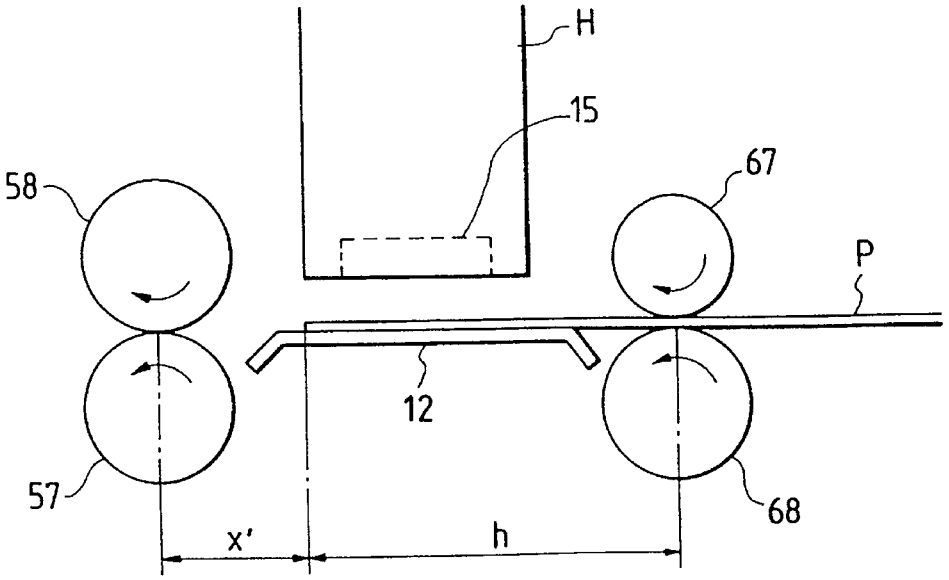
FIG. 36 PRIOR ART
FIG. 36 is an elevational sectional view for explaining a conventional control of the feeding of a sheet.

This embodiment shows an example that a sheet 2 is firstly fed by pre-print rollers 67, 68, as shown in FIG. 36. That is to say, with respect to a recording head H, post-print rollers 57, 58 are arranged at a downstream side of a sheet feeding path and pre-print rollers 67, 68 are arranged at the upstream side of the sheet feeding path. The sheet feed amount of the pre-print rollers 67, 68 is slightly smaller than that of the post-print roller 57, and the sheet pinching force of the pre-print rollers is selected to be weaker than that of the post-print rollers 57, 58, so that a moderate tension is maintained in the sheet P to prevent the slacking of the sheet.

When a distance or length between the leading end of the sheet P and a nip between the pre-print rollers 67, 68 is h and a leading end remaining amount is x', the feeding of the sheet P is effected by the following procedures (a) to (c):

(a) In case of $x'\geqq W$

The next feeding of the sheet P is also effected by the pre-print roller 68.

(b) In case of $0<x'<W$

A sheet portion from the leading end thereof to x is fed by the pre-print roller 68, and thereafter, the sheet is fed by the post-print roller 57.

(c) In case of $x'\leqq0$

The sheet P is fed by the post-print roller 57. Now, when a feed amount ratio of the pre-print roller 68 to the post-print roller 57 is f, a sheet feed amount l' for n pulses will be:

(i) In case of $x'\geqq Wf$ $l'=ntf$;

(ii) In case of $0<x'<Wf$ $l'=-\{(1-f)/f\}x'+nt$; and (iii) In case of $x'\leqq0$ $l'=nt$.

Figure 32:
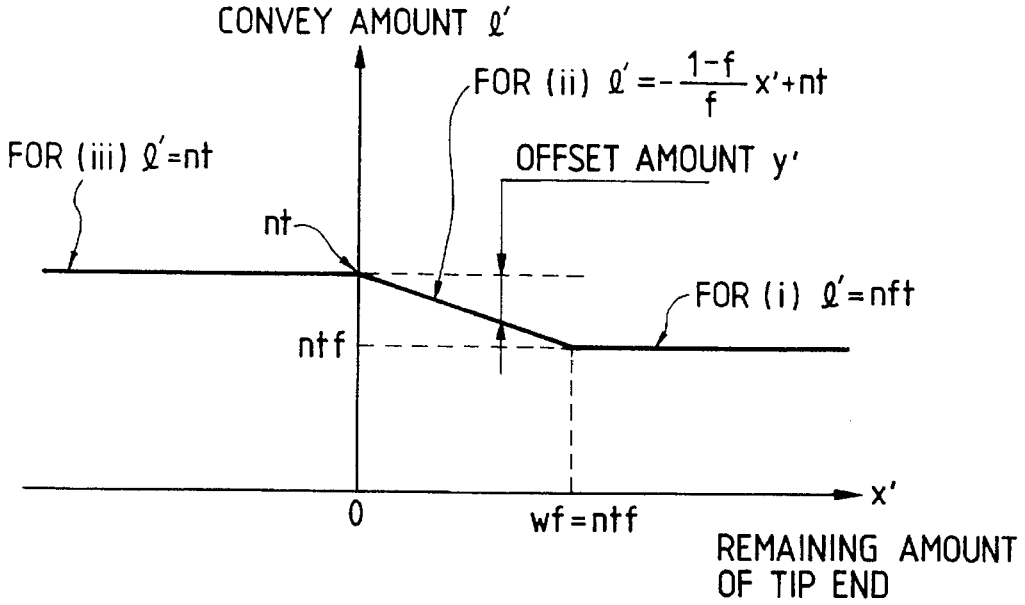
FIG. 32 is a graph showing the relation between a remaining amount of a trailing end of a sheet and a feed amount in a seventh embodiment of the present invention.

Such relation is shown in FIG. 32.

Now, when an error regarding the recording width W (i.e., l'=nt) is y', because of y'=l'−nt, the following relations are obtained:

① In case of $x'\geqq Wf$ $y'=nft-nt=(f-1)nt$;

② In case of $0<x'<Wf$ $y'=-\{(1-f)/f\}x'+nt-nt=-\{(1-f)/f\}x'$; and

③ In case of $x'\leqq0$ $y'=nt-nt=0$.

Now, because of $f<1$, in the above cases ① and ②, the relation $y'<0$ is obtained, with the result that two adjacent lines are recorded with overlapping by an amount y'.

Thus, considering the feed amount l' of the sheet P in a case where the number of pulses of the pulse motor is increased by r' pulses (i.e., n+r'), the feed amount l' will be:

(a) In case of $x' \geqq Wf+fr't$ $l'=(n+r')tf$;

(b) In case of $0<x'<Wf+r'tf$ $l'=\{(1-f)/f\}x'+(n+r')t$; and (c) In case of $x' \leqq 0$, $l'=(n+r')t$.

Figure 33:
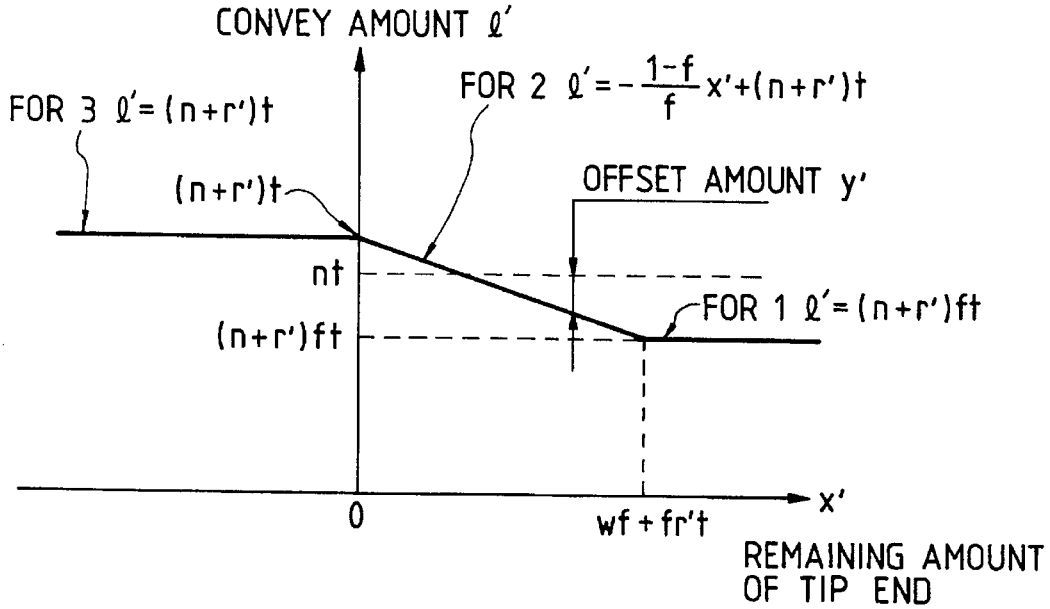
FIG. 33 is a graph showing the relation between a remaining amount of a trailing end of a sheet and a feed amount in the seventh embodiment.

Such relation is shown in FIG. 33. Now, the error y' will be:

(a) In case of $x' \geqq Wf+r'ft$ $y'=(n+r')tf-nt=nt(f-1)+r'tf$;

(b) In case of $0<x'<Wf+r'tf$ $$\begin{aligned} y' &= -\{(1-f)/f\}x'+(n+r')t-nt \\ &= -\{(1-f)/f\}x'+r't; \text{ and,} \end{aligned}$$

(c) In case of $x' \leqq 0$, $y'=r't$.

Accordingly, the relation $y'<0$ may be obtained in accordance with the values f and r', with the result that the feed amount l' of the sheet P is smaller than the recording width W, and thus, two lines are recorded with overlapping by an amount y'.

Now, when the number of dots overlapped is m", if the ink is not discharged regarding the overlapped dots m", the recording width will be W−m"d (=nt m"d). Thus, the above-mentioned error $y'=(l'-(nt-m''d))$ becomes as follows:

(a) In case of $x' \geqq (W+r't)\ f$ $y'=(n+r)tf-(nt-m''d)=nt(f-1)+r'tf+m''d$;

(b) In case of $0<x'<(W+r't)f$ $$\begin{aligned} y' &= -\{(1-f)/f\}x'+(n+r')t-(nt-m''d) \\ &= -\{(1-f)/f\}x'+r't+m''d; \text{ and,} \end{aligned}$$

(c) In case of $x' \leqq 0$, $y'=(n+r')t-(nt-m''d)=r't+m''d$.

Therefore, in case of (b), the increased pulses numbers r' and the overlapped dot numbers m" may be so selected that an absolute value of the error y' becomes minimum in accordance with the change in x'.

Similarly, in case of (a) and (c), the increased pulse numbers r' and the overlapped dot numbers m" may be so selected that an absolute value of the error y' becomes minimum. Such relation is shown in FIG. 34.

Figure 34:
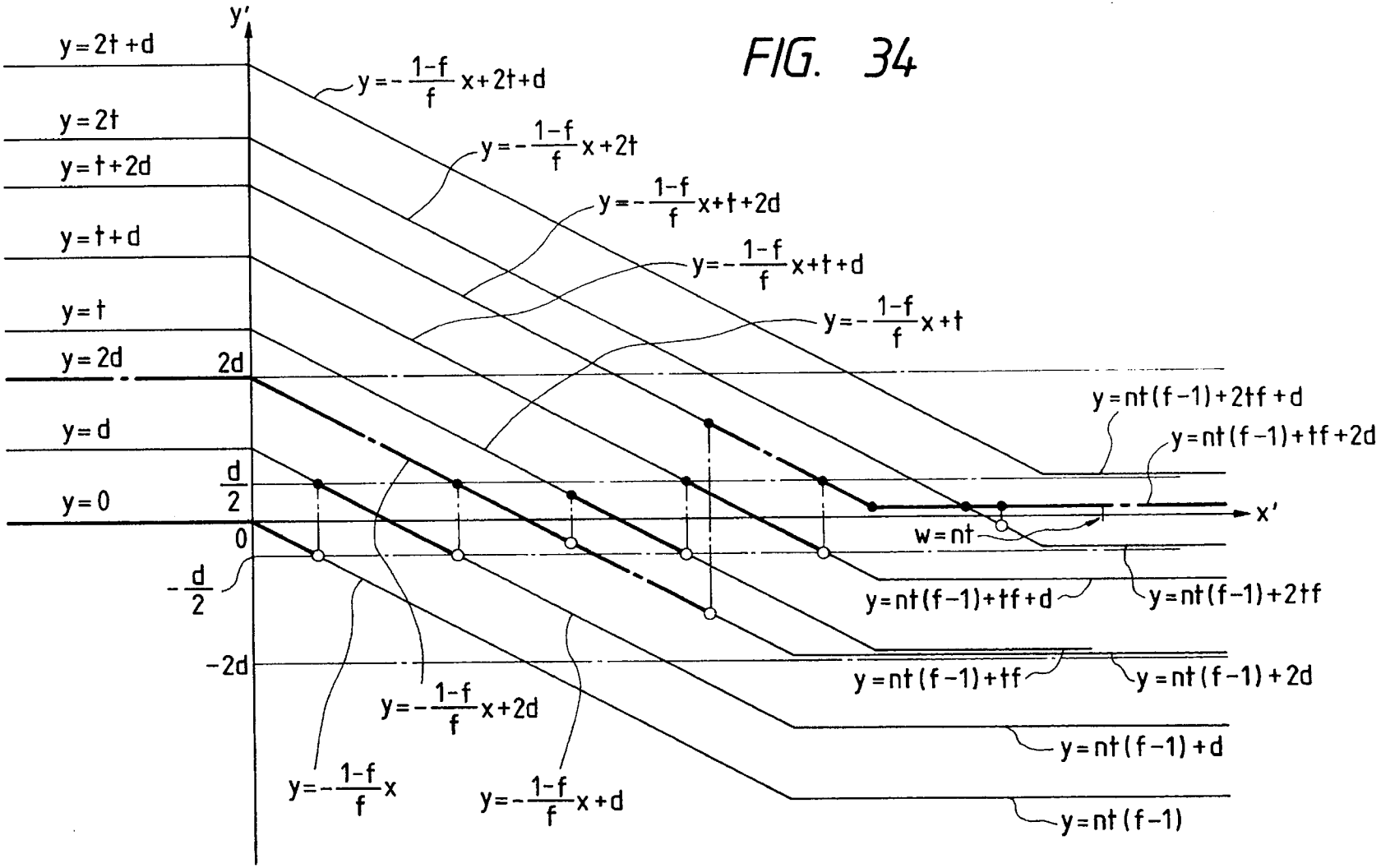
FIG. 34 is an explanatory view for explaining a trailing end treatment.

Now, it will be found that the relation shown by thick lines in FIG. 34 contributes to minimize the absolute value of the error y'. Now, the error corresponds to 1 dot (d) (±d/2 dot) at the maximum. Further, if an acceptable value of the error y' is ±2d dots, the relation shown by thick dot-and-chain lines, will be permitted, thus reducing the number of correction procedures. In this way, the optimum correction can be effected by the values of the parameters used in the formulae regarding the error y' and the acceptable value of the error y'.

Next, the remaining amount x' of the trailing end of the sheet in a case where, after the sheet P shown in FIG. 36 passes through the pre-print rollers 67, 68 and the image is recorded on the sheet, the sheet is fed by the post-print rollers 57, 58 will be explained.

Figure 35:
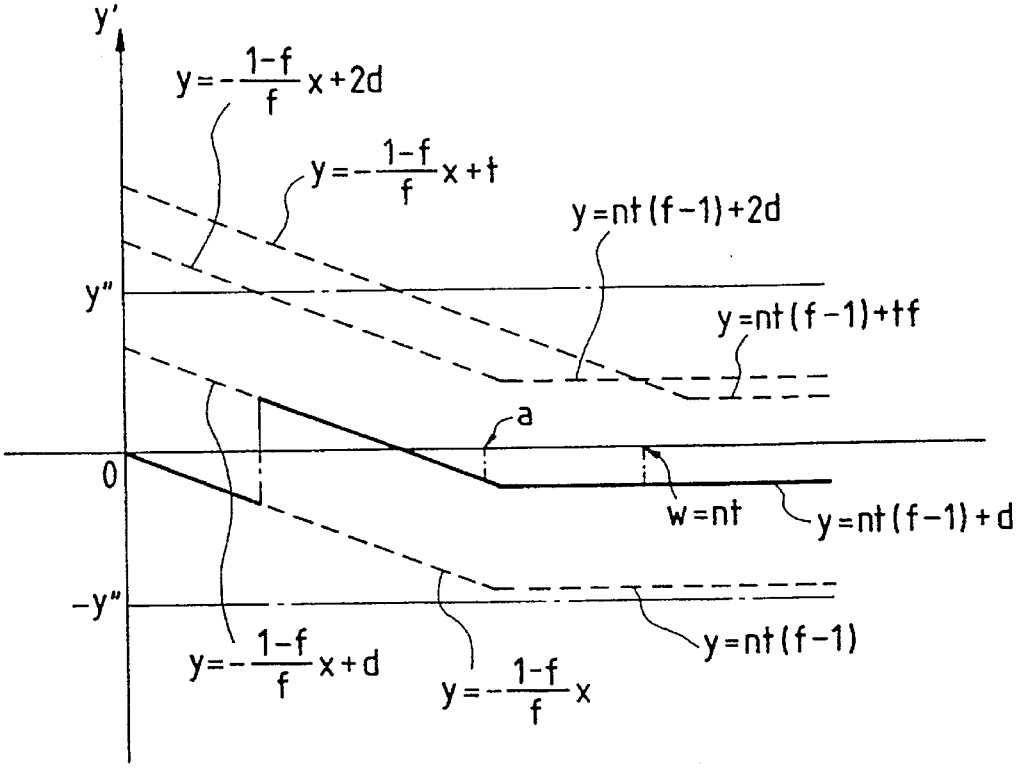
FIG. 35 is a graph for explaining the control for correction.

First of all, the sheet feed amount h firstly fed for performing the recording can be a constant value, by a sheet feeding method described in the above-mentioned Japanese Patent Application No. 1-73033 or by a method using the register shutter (Generally, this is required for eliminating the discrepancy in the recording positions). Further, since the positions of the post-print rollers 57, 58 regarding the feed amount h firstly fed are inherent to the system, the remaining amount x' of the trailing end of the sheet will be constant in that system. Thus, from the condition of the system, only one correction control is determined. For example, when control lines shown in FIG. 35 can be used and the remaining amount x' of the trailing end is determined as a from the condition of the system, until the leading end of the sheet P enters into the nip between the post-print rollers 57 and 58, by performing one dot correction, the absolute value of the error y'can be minimized.

However, if the position of the leading end of the sheet is not constant due to the feature of the feeding means, any combination of the above-mentioned sensor arm, sensor of reflection type, and sensor of permeable type may be utilized in accordance with the circumstances.

In the first to third embodiments, when the pressing force of the back-up roller 9 against the post-print roller 7 is sufficiently stronger than that of the back-up roller 8 against the pre-print roller 6, the controls are switched before the leading end of the sheet is pinched by the post-print rollers and after the leading end of the sheet is pinched by the post-print rollers.

First of all, there is provided a sensor for detecting the fact that the leading end of the sheet is pinched by the post-print rollers. And, the following three cases are considered: (a) In case where the sheet is fed only by the pre-print roller, (b) In case where the sheet is firstly fed only by the pre-print roller, and then is fed by both of the pre-print roller and the post-print roller, and (c) In case where the whole one auxiliary scanning feed is effected by both of the pre-print roller and the post-print roller. The CPU determines one of the above cases (a) to (c) on the basis of the detection signal of the sensor. The pulse motor may be controlled so that the auxiliary scanning for one-line is effected in accordance with the respective cases.

Lastly, the recording head will be explained.

Figure 37:
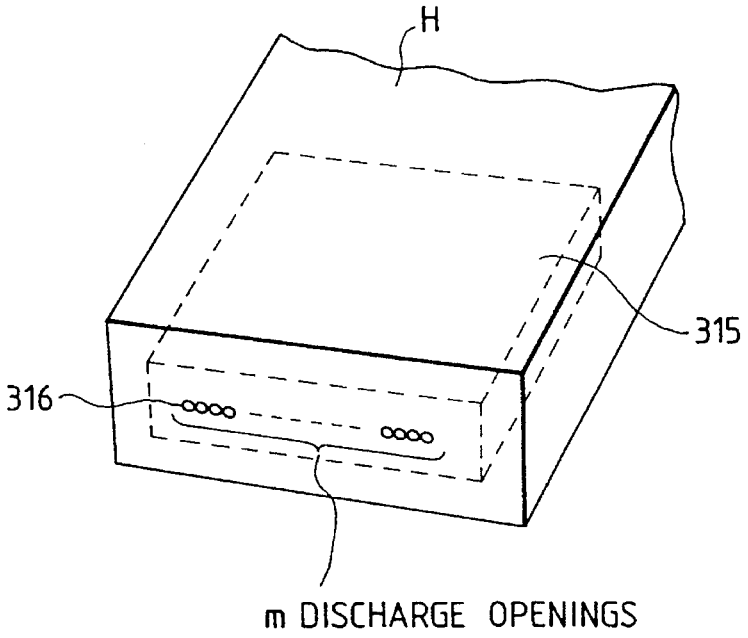
FIG. 37 is a perspective view of a recording head.
Figure 38:
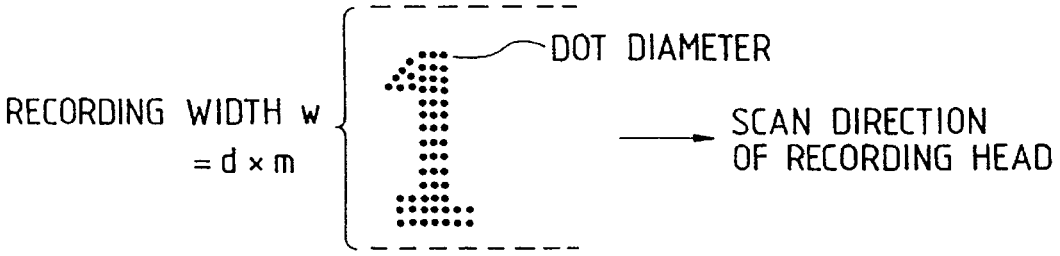
FIG. 38 PRIOR ART
FIG. 38 is a view showing an example of a recorded image.

The recording head H is of ink jet type capable of recording the image on the sheet and has m (in number) ink discharge openings 316 at an end surface of an ink discharge portion 316, as shown in FIG. 37. Further, the head has an ink chamber (not shown) formed therein for permitting the discharge of ink from the m discharge openings in response to the image signal. Further, a carriage drive motor (not shown) is connected to a carriage through a timing belt, so that the carriage can be shifted along a guide shaft by means of the carriage drive motor.

What is claimed is:

1. A recording apparatus, comprising:

recording means for recording an image on a sheet of a predetermined length;

first feeding means disposed at an upstream side of said recording means for pinching and feeding the sheet at a first feeding speed;

second feeding means disposed at a downstream side of said recording means for pinching and feeding the sheet at a second feeding speed faster than said first feeding speed; and control means for controlling said first and second feeding means so that said sheet of predetermined length is alternately fed and stopped, said control means also controlling said recording means so that recording is performed while the sheet is stopped, wherein said control means controls said second feeding means so that driving time periods of said second feeding means are different when the sheet is nipped and fed by a combination of said first and second feeding means from when the sheet is nipped and fed by only said second feeding means.

2. A recording apparatus according to claim 1, wherein said control means controls said first and second feeding means so that the sheet is fed by the predetermined length whenever the image having a predetermined length in a sheet feeding direction is recorded by said recording means.

3. A recording apparatus according to claim 2, wherein slip is generated between the sheet and said second feeding means so that the sheet is fed at said first feeding speed when the sheet is fed by both of said first and second feeding means, and said control means controls said second feeding means so that said second feeding means feeds the sheet at said first feeding speed when the sheet is fed only by said second feeding means.

4. A recording apparatus according to claim 3, further including a detection means for detecting that a trailing end of the sheet passes by said first feeding means.

5. A recording apparatus according to claim 4, wherein said control means controls a feeding speed of said second feeding means based on the detection means.

6. A recording apparatus according to claim 2, wherein slip is generated between the sheet and said first feeding means so that the sheet is fed at said second feeding speed when the sheet is fed by both of said first and second feeding means, and said control means controls said first feeding means so that said first feeding means feeds the sheet at said second feeding speed when the sheet is fed only by said first feeding means.

7. A recording apparatus according to claim 2, wherein, when the sheet is fed by both of said first and second feeding means, said control means controls said first and second feeding means to activate said first feeding means for feeding the sheet by a first length and to activate said second feeding means for feeding the sheet by a second length longer than said first length whenever said recording means records an image having said first length in said sheet feeding direction, and slip is generated between the sheet and said second feeding means so that the sheet is fed by said first length.

8. A recording apparatus according to claim 7, wherein, when only said second feeding means is feeding said sheet, said second feeding means is controlled so that the sheet is fed by said first length whenever said recording means records the image.

9. A recording apparatus according to claim 8, wherein after the image having the first length in a feeding direction is formed and when the feeding is started by said first and second feeding means, and a trailing end of the sheet passes through said first feeding means before a first distance feeding is completed, the sheet is fed only by said second feeding means until the first distance feeding is completed.

10. A recording apparatus according to claim 9, further including a detection means for detecting that a trailing end of the sheet passes through said first feeding means.

11. A recording apparatus according to claim 10, wherein said control means controls a feeding length of said second feeding means based on the detection signal of said detection means.

12. An apparatus according to claim 2, wherein when said recording means records an image having a second length; and, when the sheet is fed by both of said first and second feeding means, said control means controls said first and second feeding means so that said first feeding means feeds the sheet by a first length and said second feeding means feeds the sheet by said second length, longer than said first length, whenever said recording means records the image, and slip is generated between the sheet and said first feeding means so that the sheet is fed by said second length.

13. A recording apparatus according to claim 12, wherein, when only said first feeding means is feeding said sheet, said first feeding means is controlled so that the sheet is fed by said second length whenever said recording means records the image.

14. A recording apparatus according to claim 12, wherein after the image having the second length in a feeding direction is formed by said recording means, and when the feeding is started by said first feeding means, and a trailing end of the sheet passes through said second feeding means before a second distance feeding is completed, the sheet is fed by said first and second feeding means until the second distance feeding is completed.

15. A recording apparatus according to claim 1, wherein said first and second feeding means comprise a pair of rollers for pinching and feeding the sheet, respectively.

16. A recording apparatus according to claim 1, wherein said recording means includes an ink jet head that records by discharging ink.

17. A recording apparatus according to claim 1, wherein said recording means includes an ink jet head that records by discharging ink by utilizing thermal energy.

18. A recording apparatus, comprising:

record means for recording an image onto a sheet;

first convey means disposed upstream of said record means for applying a first convey force to the sheet to convey the sheet at a first speed;

second convey means disposed downstream of said recording means for applying a second convey force to the sheet to convey the sheet by a speed different from the first speed;

control means for controlling said first and second convey means to convey the sheet by a predetermined length and to stop conveying said sheet alternately, the recording being effected while the sheet is stopped; and said control means controlling said first and second convey means so that a conveyed amount of the sheet, when conveyed by both of said first and second convey means, is the same as a conveyed amount of the sheet when conveyed by only said first or second convey means.

19. A recording apparatus according to claim 18, wherein said first convey means has a first rotary member applying a first convey force to the sheet by rotating at a first peripheral speed while contacting the sheet, and said second convey means has a second rotary member applying a second convey force to the sheet by rotating at a second peripheral speed larger than the first peripheral speed while contacting the sheet.

20. A recording apparatus according to claim 19, wherein said recording apparatus is so constructed that the sheet slips over said second rotary member when the sheet contacts both of said first and second rotary members, and said control means controls said second rotary member to convey the sheet with the first peripheral speed when the sheet is conveyed by only said second rotary member.

21. A recording apparatus according to claim 19, wherein said recording apparatus is so constructed that the sheet slips over said second rotary member when the sheet contacts both of said first and said second rotary members, and said control means controls said first and said second rotary members so that a rotational amount of said second rotary member is selected to be smaller when the sheet contacting both of said first and said second rotary members is changed to contact only said second rotary member, than when the sheet contacts both of said first and said second rotary members for conveying the sheet by the predetermined length.

22. A recording apparatus according to claim 18, wherein said recording apparatus is so constructed that the sheet slips over said second convey means when the sheet contacts both of said first and second convey means, and said control means controls said first and second convey means so that a convey time of said second convey means is selected to be smaller when the sheet contacting both of said first and second convey means is changed to contact only said second convey means, than when the sheet contacts both of said first and second convey means for conveying the sheet by the predetermined length.

23. A recording apparatus according to claim 18, further comprising detection means for detecting whether a trailing end of the sheet has passed by said first convey means.

24. A recording apparatus according to claim 18, wherein after the image having a first length in a conveying direction is formed by said recording means, and when the conveying is started by said first and second conveying means and a trailing end of the sheet passes through said first conveying means before a first distance conveying is completed, the sheet is conveyed by only said second conveying means until the first distance conveying is completed.

25. A recording apparatus according to claim 18, further comprising length detection means for detecting a length of the sheet to be conveyed in a conveying direction, and wherein said control means determines whether the sheet has passed by said first convey means during conveying based on a length of the sheet in the conveying direction detected by said length detection means and a conveyed distance of the sheet from a predetermined position, to thereby control a conveying time of said second convey means up to stoppage.

26. A recording apparatus according to claim 18, wherein said recording means has an ink jet head for discharging ink for recording.

27. A recording apparatus according to claim 18, wherein said recording means has an ink jet head for discharging ink for recording by utilizing thermal energy.

28. A recording apparatus according to claim 18, further comprising a pulse motor for driving said first and second convey means, and wherein the conveying amount of said first and second convey means is controlled by a number of pulses of said pulse motor.

29. A recording apparatus, comprising:

a record means for recording an image on a sheet;

first convey means disposed upstream of said record means for applying a first convey force to the sheet for conveying the sheet at a first speed;

second convey means disposed downstream of said record means for applying a second convey force to the sheet for conveying the sheet at a second speed which is faster than the first speed;

control means for controlling said first and second convey means to convey the sheet by a predetermined length and to stop conveying said sheet alternately, and controlling said recording means to effect recording during sheet stoppage;

detection means for detecting whether a trailing end of the sheet passes by said first convey means and for generating a detection signal in response to said detection; and said control means controlling said second convey means to change a speed thereof from the second speed to the first speed when said detection means generates the detection signal.

30. A recording apparatus according to claim 29, wherein said first convey means has a first rotary member rotating in a first peripheral speed while contacting the sheet for applying the first convey force to the sheet, and said second convey means has a second rotary member rotating in a second peripheral speed faster than the first peripheral speed while contacting the sheet for applying the second convey force to the sheet.

31. A recording apparatus according to claim 29, wherein said recording means has an ink jet head for discharging ink for recording.

32. A recording apparatus according to claim 31, wherein said recording means has an ink jet head for discharging ink for recording by utilizing thermal energy.

33. A recording apparatus, comprising:

record means for recording an image onto a sheet;

first convey means disposed upstream of said record means for applying a first convey force of a first speed to the sheet to convey the sheet;

second convey means disposed downstream of said record means for applying a second convey force of a second speed which is faster than the first speed to the sheet;

control means for controlling said first and second convey means to convey the sheet by a predetermined length and to stop conveying alternatively, so that the image is recorded during sheet stoppage; and position detection means for detecting a position of a trailing end of the sheet, said control means varying a recording area by said record means, corresponding to the position of the sheet trailing end detected by said position detection means.

34. A recording apparatus according to claim 33, wherein said first convey means has a first rotary member for applying the first convey force to the sheet by rotating at a first peripheral speed while contacting the sheet, and said second convey means has a second rotary member for applying the second convey force to the sheet by rotating at a second peripheral speed which is faster than the first peripheral speed while contacting the sheet.

35. A recording apparatus according to claim 34, wherein said recording apparatus is so constructed that the sheet slips over said second rotary member when the sheet contacts both of said first and said second rotary members.

36. A recording apparatus according to claim 35, wherein said control means controls said first and said second rotary members so that a rotational amount of said second rotary member is selected to be smaller when the sheet contacting both of said first and said second rotary members is changed to contact only said second rotary member, than when the sheet is conveyed by the predetermined length while contacting both of said first and said second rotary members.

37. A recording apparatus according to claim 33, wherein a conveying time period when sheet conveying is started by both of said first and second conveying means and the sheet is conveyed by only said second conveying means after the sheet passes through said first conveying means is shorter than a conveying time period when the sheet is conveyed by both of said first and second conveying means throughout the predetermined length.

38. A recording apparatus according to claim 33, further comprising a pulse motor for driving said first and second conveying means, and wherein when sheet is conveyed a predetermined distance, a pulse by said pulse motor, when the sheet conveying is started by both of said first and second conveying means and the sheet is conveyed by only said conveying means after the sheet passes through said first conveying means, is smaller than a pulse by said motor when the sheet is conveyed by both of said first and second conveying means throughout the predetermined length.

39. A recording apparatus according to claim 33, wherein said position detection means has a sensor for detecting whether the sheet trailing end passes by a predetermined position upstream of said first convey means.

40. A recording apparatus according to claim 39, wherein said position detection means detects, when said sensor detects the sheet trailing end during conveying of a predetermined length, the position of the sheet trailing end based on a conveyed amount from the detection of sheet trailing end to completion the of predetermined length conveying.

41. A recording apparatus according to claim 33, wherein said control means makes a recording area smaller so that the recording by said recording means does not duplicate the record formed by a previous recording.

42. A recording apparatus according to claim 33, further comprising length detection means for detecting a length of the sheet in a conveying direction, and said position detection means detects the position of a sheet trailing end based on a length of the sheet in the conveying direction and a conveyed amount of the sheet from a predetermined position.

43. A recording apparatus according to claim 42, wherein position of the sheet trailing end is detected based on conveyed amount of the sheet from the sheet leading end opposes to said first convey means.

44. A recording apparatus according to claim 33, further comprising a pulse motor for driving both of said first and second convey means, and wherein a conveying amount of the sheet is measured by the number of pulses of said pulse motor.

45. A recording apparatus according to claim 33, wherein said recording means has an ink jet head for discharging ink for recording.

46. A recording apparatus according to claim 33, wherein said recording means has an ink jet head for discharging ink for recording by utilizing thermal energy.

47. A recording apparatus, comprising:

record means for recording an image onto a sheet;

first convey means disposed upstream of said record means for applying a convey force of a first speed to the sheet to convey the sheet;

second convey means disposed downstream of said record means for applying a convey force of a second speed which is faster than the first speed to the sheet;

control means for controlling said first and second convey means to convey the sheet by a predetermined length and to stop conveying the sheet alternately, and for controlling said record means to record the image onto the sheet during sheet stoppage; and position detection means for detecting a position of a sheet leading end, wherein said control means varies the conveying amount of the sheet by said first convey means and the recording area by said recording means in an amount corresponding to a position of the sheet leading end detected by said position detection means.

48. A recording apparatus, comprising:

record means for recording an image onto a sheet;

first convey means disposed upstream of said record means for nipping and conveying the sheet in a first convey speed;

second convey means disposed downstream of said record means for nipping and conveying the sheet in a second convey speed;

control means for controlling said first and second convey means and said recording means to effect conveyance of the sheet a predetermined length and stoppage of the sheet, alternatively, and to effect the recording of the image when the sheet is stopped;

wherein said control means controls said first and said second convey means, during conveyance from a stopped state to a next stoppage, so that the sheet is conveyed by the same length when the sheet is conveyed by said first and said second convey means and when application of one of said first convey means and said second convey means is changed in the course of a sheet conveyance.

49. A recording apparatus according to claim 48, wherein said control means controls said first and said second convey means so that a convey time period when application of one of said first convey means and said second convey means is changed in the course of conveyance is different from when the sheet is conveyed by said first and said second convey means by the predetermined length.

50. A recording apparatus according to claim 49, wherein one of said first and said second convey means is driven by a pulse motor, and convey time periods thereof are changed by changing the number of pulses applied to the pulse motor.

51. A recording apparatus according to claim 49, wherein the second convey speed is faster than the first convey speed so that the sheet slips relative to said second convey means when the sheet contacts with said first and said second convey means; and said control means controls said first and said second convey means so that the convey time period when a convey condition changes from a first condition where the sheet is conveyed by said first and said second convey means to a second condition where the sheet is conveyed by said second convey means is shorter than a conveyed distance when the sheet is conveyed by said first and said second convey means by the predetermined length.

52. A recording apparatus according to claim 48, wherein said first and said second convey means are driven by a pulse motor, and the second convey speed is faster than the first convey speed so that the sheet slips relative to said second convey means when the sheet contacts said first and said second convey means; said control means reduces the number of pulses applied to the pulse motor when a convey condition is changed from a condition where the sheet is conveyed by said first and said second convey means to a condition where the sheet is conveyed by said second convey means during a start of conveyance from a stopped state to a next stoppage that is smaller than when the sheet is conveyed by said first and said second convey means by the predetermined length.

53. A recording apparatus according to claim 52, wherein said control means applies M-pulses to the pulse motor and stops, when the sheet conveyance starts from the stopped state and the sheet trail end passes through said first convey means after N-pulses are applied to the pulse motor, wherein an equation is satisfied where:

$$L_o \times N + L_o \times M \times V_2 / V_1 = W$$

Here, $L_o$: convey length per one pulse by first convey means $V_1$: first convey speed $V_2$: second convey speed W: predetermined length.

54. A recording apparatus according to claim 53, wherein said first convey means has a first rotary member rotating at a first peripheral speed while contacting the sheet for applying convey force to the sheet, and said second convey means has a second rotary member rotating at a second peripheral speed faster than the first peripheral speed for applying convey force to the sheet.

55. A recording apparatus according to claim 53, further comprising detect means for detecting passage of the sheet trailing end at said first convey means.

56. A recording apparatus according to claim 53, further comprising detect means for detecting a size of the sheet, wherein said control means determines timing when the sheet trial end passes through said first convey means according to the sheet size detected by said detect means.

57. A recording apparatus according to claim 52, wherein said first and said second convey means convey the sheet by length $L_1$ defined by the following equation (A) in each time when said record means effects a recording having length $L_1$ in the convey direction of the sheet, and in the n-th conveyance defined by the equation (A) from the first recording of length $L_1$, said first and said second convey means convey the sheet by $M_2$ pulses defined by the following equation (B) and then stop, $$L_1 \times n < L_p - 1 \leqq L_1 \times (n+1) \quad (A)$$

$$M_2 = \{(L-1) - L_1 \times n\}/L_o + \{L_1 - L_p + 1 + L_1 \times n\}/(L_o \times R) \quad (B)$$

where, $L_p$: length of sheet in convey direction $L_o$: convey length per one pulse by first convey means $V_1$: first convey speed $V_2$: second convey speed l: distance between recording means and first convey means

R: $V_2/V_1$.

58. A recording apparatus according to claim 48, wherein the second convey speed is faster than the first convey speed so that the sheet slips relative to said second convey means when the sheet is conveyed by said first and said second convey means; and said control means reduces the convey speed of said second convey means from the second convey speed to the first convey speed when a convey condition changes from a first condition where the sheet is conveyed by said first and said second convey means to a second condition where the sheet is conveyed by said second convey means during a time period from a start of conveyance from the stopped state to the next stoppage.

59. A recording apparatus, comprising:

recording means for recording an image on a sheet;

first convey means disposed upstream of said record means for conveying and nipping a sheet in a first convey speed;

second convey means disposed downstream of said recording means for conveying and nipping a sheet in a second convey speed; and control means for controlling said first and said second convey means and said recording means so that conveyance of the sheet a predetermined length and stoppage of the sheet are effected alternately, and an image is recorded on the sheet when the sheet is stopped;

wherein said control means further controls said first and said second convey means so that the sheet is conveyed by the same length both when the sheet is conveyed by said first and said second convey means and when the sheet is conveyed by said second convey means, during a start of conveyance from a stopped state to the next stoppage.

60. A recording apparatus according to claim 59, wherein said control means controls said first and said second convey means so that a convey time period is different between when the sheet is conveyed by said first and said second convey means and when the sheet is conveyed by said second convey means during the start of conveyance from the stopped state to next stoppage.

61. A recording apparatus according to claim 60, wherein the second convey speed is faster than the first convey speed so that the sheet slips relative to the second convey means when the sheet contacts said first and said second convey means, and said control means controls said first and said second convey means so that a convey time period when the sheet is conveyed by said first and said second convey means is shorter than a convey time period when the sheet is conveyed by said second convey means during the start of conveyance from the stopped state to the next stoppage.

62. A recording apparatus according to claim 59, wherein one of said first and said second convey means is driven by a pulse motor so that the first convey speed is faster than the second convey speed for causing the sheet to slip over said second convey means when the sheet contacts said first and said second convey means; and said control means control said first and said second convey means so that the number of pulses applied to the pulse motor during a start of conveyance from a stopped state to a next stoppage when the sheet is conveyed by said second convey means is reduced compared to when the sheet is conveyed by said first and said second convey means.

63. A recording apparatus according to claim 59, wherein the second convey speed is faster than the first convey speed so that the sheet slips relative to said second convey means when the sheet is conveyed by said first and Said second convey means; and said control means controls said first and said second convey means so that the convey speed when the sheet is conveyed by said second convey means is equal to the convey speed when the sheet is conveyed by said first and said second convey means during the start of conveyance from a stopped state to the next stoppage.

64. A recording apparatus according to claim 59, wherein the second convey speed is faster than the first convey speed so that the sheet slips over said second convey means when conveyed by said first and said second convey means; and said control means controls said second convey means to convey the sheet at the first convey speed when the sheet is conveyed by said second convey means.

65. A recording apparatus according to claim 64, wherein said first convey means has a first rotary member rotating in a first peripheral speed while contacting with the sheet, and said second convey means has a second rotary member rotating in a second peripheral speed faster than the first speed with contacting with the sheet to apply the convey force to the sheet.

* * * * *

UNITED STATES PATENT AND TRADEMARK OFFICE

CERTIFICATE OF CORRECTION

PATENT NO. : 5,602,571

DATED : February 11, 1997

INVENTOR(S) : Masashi SUDA, et al.

It is certified that error appears in the above-indentified patent and that said Letters Patent is hereby corrected as shown below:

On the Cover Sheet, In the ABSTRACT

Line 8, "frist" should read --first--;

Line 10, "roller" should read --rollers--.

COLUMN 6

Line 48, "It is" should read --If--.

COLUMN 9

Line 55, "Japanese Patent Laid-Open No. 59. 59-12367" should read --Japanese Patent Laid-Open No. 59-123670--.

COLUMN 13

Line 46, "y=(n-r)t-(nt-re'd)=-rt+m'd" should read --y=(n-r)t-(nt-m'd)=-rt+m'd;--.

COLUMN 17

Line 26, "to" (first occurrence) should be deleted.

UNITED STATES PATENT AND TRADEMARK OFFICE

CERTIFICATE OF CORRECTION

PATENT NO. : 5,602,571

DATED : February 11, 1997

INVENTOR(S) : Masashi SUDA, et al.

It is certified that error appears in the above-indentified patent and that said Letters Patent is hereby corrected as shown below:

COLUMN 18

Line 3, "hen" should read --then--;

Line 12, Close right margin.

COLUMN 19

Line 31, "W-m"d(=nt m"d)." should read --W-m"d(=nt-m").--.

COLUMN 20

Line 14, "y'can" should read --y' can".

COLUMN 21

Line 65, "length;" should read --length,--.

COLUMN 22

Line 60, "and" (first occurrence) should read --and said--.

UNITED STATES PATENT AND TRADEMARK OFFICE

CERTIFICATE OF CORRECTION

PATENT NO. : 5,602,571

DATED : February 11, 1997

INVENTOR(S) : Masashi SUDA, et al.

It is certified that error appears in the above-indentified patent and that said Letters Patent is hereby corrected as shown below:

COLUMN 25

Line 17, "the of" should read --of the--, and "conveying." should read --conveyed.--.

COLUMN 28

Line 34, "control" should read --controls--;

Line 44, "Said" should read --said--;

Line 63, "with" (first occurrence) should read --while--.

Signed and Sealed this

Seventh Day of October, 1997

Bruce Lehman

*Attest:*

BRUCE LEHMAN

*Attesting Officer*

*Commissioner of Patents and Trademarks*